US011033086B2

(12) United States Patent
Tedesco et al.

(10) Patent No.: US 11,033,086 B2
(45) Date of Patent: Jun. 15, 2021

(54) CONTAINER DIVIDERS FOR CAMERA BAGS, BACKPACKS, AND OTHER CONTAINERS, AND ASSOCIATED SYSTEMS

(71) Applicant: Atlas Packs LLC, Phoenix, AZ (US)

(72) Inventors: David Tedesco, Scottsdale, AZ (US); Allan Henry, Scottsdale, AZ (US)

(73) Assignee: Atlas Packs, LLC, Phoenix, AZ (US)

( * ) Notice: Subject to any disclaimer, the term of this patent is extended or adjusted under 35 U.S.C. 154(b) by 0 days.

(21) Appl. No.: 16/698,700

(22) Filed: Nov. 27, 2019

(65) Prior Publication Data

US 2020/0107622 A1 Apr. 9, 2020

Related U.S. Application Data

(63) Continuation of application No. PCT/US2019/000021, filed on May 6, 2019.

(60) Provisional application No. 62/667,613, filed on May 6, 2018.

(51) Int. Cl.
*A45C 13/02* (2006.01)
*A45F 4/02* (2006.01)

(52) U.S. Cl.
CPC ..... *A45C 13/02* (2013.01); *A45F 4/02* (2013.01); *A45C 2013/026* (2013.01)

(58) Field of Classification Search
CPC ..... A45C 13/02; A45C 2013/026; A45F 4/02
See application file for complete search history.

(56) References Cited

U.S. PATENT DOCUMENTS

| | | | | |
|---|---|---|---|---|
| 2,010,471 | A | 8/1935 | Ygberg | |
| 3,381,782 | A | 5/1968 | Ikelheimer | |
| 5,356,004 | A | 10/1994 | Weinreb | |
| 5,573,114 | A | 11/1996 | Cyr | |
| 5,652,039 | A | 7/1997 | Tremain et al. | |
| 5,906,290 | A * | 5/1999 | Haberkorn | B65D 81/3886 190/110 |

(Continued)

OTHER PUBLICATIONS

EvaDura EVA, www.nexusfoams.com (Year: 2020).*

(Continued)

*Primary Examiner* — Tri M Mai
(74) *Attorney, Agent, or Firm* — Transformative Legal, LLC; Len S. Smith; Denise M. Brown

(57) ABSTRACT

New container dividers, related systems/container components, and containers comprising such systems along with other features are described herein and provided by this invention. In one aspect, container dividers comprising one or more dual position transformable dividers or sections are provided that allow for easy reallocation of storage capacity from one formable compartment to another, typically by application of a modest amount of force (e.g., a moderate pull). Once in a resting configuration the dividers resist structural deformation based on a combination of structural features. In some aspects containers are provided wherein a number of dividers can form two or more formable compartments. Also provided are new removable, flexible and reconfigurable multi-point dividers that can form linear, stacked, and diverse arrangements through allowing rotation approaching about 360 degrees along multiple hinges and that also or alternatively can be incorporated into containers of the invention.

20 Claims, 21 Drawing Sheets

(56) References Cited

U.S. PATENT DOCUMENTS

| | | | | |
|---|---|---|---|---|
| 6,161,739 | A | 12/2000 | Bentzen | |
| 7,600,275 | B2 * | 10/2009 | Al-Sabah | A47C 3/16 5/417 |
| 7,959,048 | B1 | 6/2011 | Cyr | |
| 8,033,405 | B2 * | 10/2011 | Wang | A47B 43/02 211/118 |
| 8,281,950 | B2 * | 10/2012 | Potts | A45C 7/0077 220/531 |
| 9,211,002 | B2 * | 12/2015 | Lo | A47B 47/06 |
| 9,615,642 | B2 * | 4/2017 | Bergh | A45C 13/02 |
| 9,820,556 | B2 | 11/2017 | Adams et al. | |
| 2011/0119832 | A1 * | 5/2011 | Hung | A47D 9/005 5/655 |
| 2014/0079344 | A1 * | 3/2014 | Quehl | A45C 13/02 383/210 |
| 2014/0131412 | A1 | 5/2014 | Canton | |
| 2014/0202814 | A1 | 7/2014 | Collins | |
| 2015/0351510 | A1 | 12/2015 | Zwetzig | |

OTHER PUBLICATIONS

Ultralon, www.ultralon.co.nz (Year: 2020).*

PCT/US19/00021 International Search Report, dated Jul. 23, 2019.

PCT/US19/00021 Written Opinion of the International Searching Authority, dated Jul. 23, 2019.

Bailey, Dan Bailey Photo Blog: New Adventure Photography Camera Packs by Atlas Packs, Web blog available via: https://danbaileyphoto.com/blog/new-adventure-photography-camera-packs-by-atlas-packs/, Feb. 5, 2018 (downloaded Nov. 27, 2019).

Sim, photofocus: Gear Review: Atlas Packs 'Athlete', Web article available via: https://photofocus.com/photography/gear-photography/reviews-photography/gear-review-atlas-packs-athlete/, Aug. 17, 2017 (downloaded Nov. 27, 2019).

Ramsey Jr., Fstoppers: Gear for Photographers and Videographers at the Outdoor Retailer Trade Show, Web article available via: https://fstoppers.com/bts/gear-photographers-and-videographers-outdoor-retailer-trade-show-218443, Feb. 5, 2018 (downloaded Nov. 27, 2019).

* cited by examiner

CONTAINER DIVIDERS FOR CAMERA BAGS, BACKPACKS, AND OTHER CONTAINERS, AND ASSOCIATED SYSTEMS

CROSS-REFERENCE TO RELATED APPLICATIONS

This patent application is a continuation of PCT application PCT/US2019/000021 (publication number WO/2019/216959) which claims priority to U.S. Provisional Patent Application No. 62/667,613, filed May 6, 2018, the contents of which are hereby incorporated in their entirety.

BACKGROUND OF THE INVENTION

Currently many types of storage containers, such as portable carriers, have been designed for a multitude of purposes: luggage specifically designed to carry clothing and other accessories in transport; computer bags or satchels designed to carry laptop computers and other electronic devices, and backpacks designed for general purpose use or for very specific applications (e.g., carrying photographic equipment) provide just a few examples. A wide variety of such storage containers are known and commercially available. Given our mobile society and recent strong interest in recreational outdoor activities, combined with increasing cost of high capability containers, there is a drive to provide increased functionality to a large number of containers.

Briefcases, backpacks, and other forms of luggage are types of containers where there has been a tradition of proposing, developing, and implementing progressive techniques and strategies to add increasingly sophisticated storage functionality. For example, U.S. Pat. No. 3,381,782 discloses a variety of different types of separators for use in cases such as briefcases and luggage. More recent examples of such efforts applied to backpacks include the approaches described in U.S. Pat. Nos. 7,959,048, 9,820,556, US Patent Application Publication No. 20150351510, and U.S. Pat. No. 9,615,642.

A movable component capable of changing from one position to another in a container, thereby providing a modular resizing of separated compartments in the container, represents one approach to providing increased container functionality in containers such as backpacks. Examples of such packs have previously been developed and marketed as "origami core" packs by Atlas Packs, LLC ("Atlas", Scottsdale, Ariz., USA). These packs incorporate a single movable component and utilized a side wall design in which side wall panels were of uniform thickness. In addition, these packs included a traditional set of insert dividers which, while configurable, had limits to the possible configurations and required multiple, separate panels for use in separating other parts of the pack.

With the present invention, the functionality of the modular components of these previously known systems has been markedly improved and expanded upon in a number of ways, including, e.g., providing a more robust stability, improving the ease of movement for the movable components, and allowing the incorporation of multiple transformable divider sections. The invention also provides new container systems in which a reversibly partially transformable container of the invention is adapted for use with a larger, master container, that is configured to receive and stably contain the transformable container. In addition, the inventors have invented novel multi-point adjustable insert dividers that are useful in separating areas of luggage and other container systems, expanding configurability of the storage space in such containers with one or a few interconnected divider systems as compared to the numerous dividers commonly used to achieve the same result in current leading container systems. Such new improvements set the aspects of this invention distinctly apart from previously known (prior art) systems, including the origami core packs previously marketed by Atlas. These and other devices, systems, methods, and respective advantages of each are further described below.

BRIEF DESCRIPTION OF THE DRAWINGS/FIGURES

DETAILED DESCRIPTION OF THE INVENTION

Figure 1:
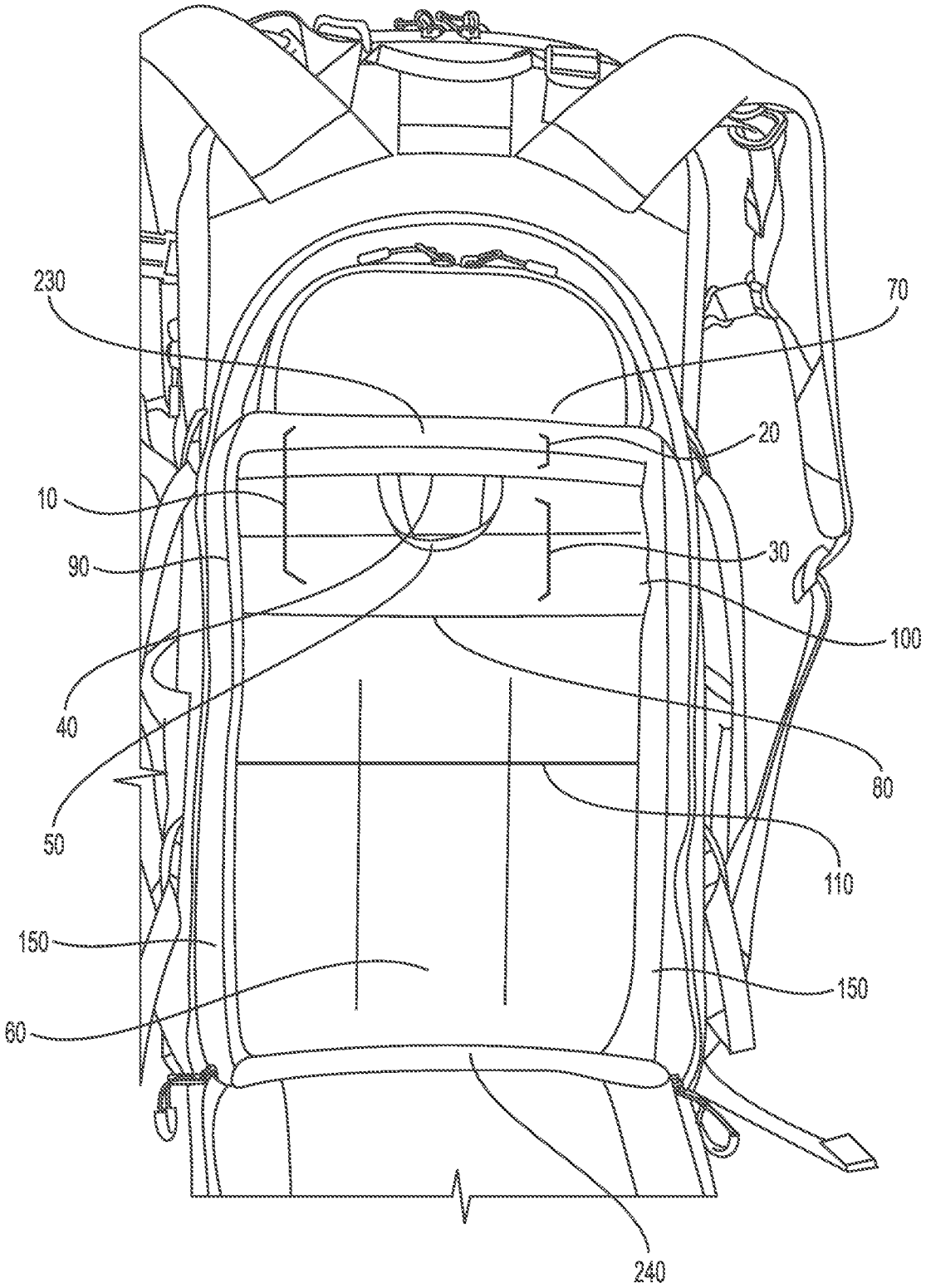
FIG. 1 is a view of a transformable divider within an embodiment with the transformable divider in a first position.

The inventive devices described herein and/or illustrated in the figures provided herewith are generally composed of or embodied in different types of new types of dividers for containers, new systems/components of containers associated with one or more of such dividers, and containers comprising such dividers.

One aspect of the invention is embodied in a new type of dual position transformable divider system wherein the dual position transformable divider system interacts with two or more surrounding structures, which structures typically are sidewalls of an associated container, in at least one of the positions and/or in the transition/transformation state between two stable positions that the transformable divider normally takes on when containing stored material(s) (cargo), such as various items. Thus, in one aspect the invention can be viewed as providing a reversibly partially transformable container, wherein the container comprises at least one dual position transformable divider, and wherein the transformable divider is capable of maintaining contents in position in either its first or second position and can be repeatedly repositioned over an expected number of uses (e.g., at least 10 uses, at least 20 uses, at least about 50 uses, at least about 100 uses, at least about 200 uses, at least about 250 uses, at least about 300 uses, at least about 400 uses, at least about 500 uses, or at least about 1000 uses).

Another aspect of the invention is container systems comprising two or more dual position transferrable divider systems, such as systems in which one or more of the two or more dual position transferrable divider systems can work independently of each other and in concert to form a first configuration (in which none of the dividers is in the transformed position), a second configuration (in which one or more of the dividers is in the transformed position), and a third configuration (in which all of the dividers are in their respective transformed positions).

Still another facet of the invention is in a third kind of divider, which is a multi-point-adjustable divider that can form a tightly stacked configuration, a linear configuration, and a number of intermediate positions, due to the ability of at least three panels of the divider to be able to rotate about 360 degrees (e.g., at least about 300 degrees, at least about 320 degrees, at least about 330 degrees, at least about 340 degrees, or at least about 350 degrees) around one or more hinges that interconnect the panels of the divider. Such stackable-linear-rotational ("SLR") dividers can be independently incorporated in a container as a removable element or done so in combination with any of the dual position transformable divider systems described herein.

These aspects of the invention can be present independently, in combination with each other, and/or in combination with other features of containers previously known in the art (such as straps for holding the container, additional compartments for storage such as pockets, which may be selective enclosures, and/or stability measures such as frames). Nonlimiting examples of such possible additional features/components are embodied in the exemplary backpack containers disclosed and described with reference to the figures provided herein.

Also provided explicitly and implicitly by the description provided herein are methods of making any or all of such dividers, systems, and containers, as well as methods of using such dividers, systems, and containers, for segregating, storing, securing, and/or transporting cargo, such as a plurality of objects (e.g., food items and books; a computer and papers; or two or more pieces of camera gear).

In a more particular exemplary aspect, the invention provides a container comprising a section comprising (a) a set of opposing sidewalls having a top end and a bottom end, each sidewall comprising one or more friction reduction area(s) located near the top, bottom, or both ends and (b) a dual position transformable divider comprising a first panel and a second panel connected by a central hinge, the divider being capable of assuming a first position and a second position by applying a force on at least one panel or to the central hinge, either directly or via an attached interaction mechanism such as a handle, such that the panels transitionally move about the hinge, the first (upper) panel being horizontally oriented in the first position and vertically oriented in the second position and the first and second panels being substantially perpendicular to each other in either position, each panel comprising a central portion that allows for some observable amount of reversible bending about the central portion (as compared to at the ends of the panels and/or as can be detected during movement between the first and second positions, at least half of the first panel), and most, substantially all, or even the entirety of the second panel being disposed below the top end of the side walls in the second position, the panels comprising a support material that has a strength such that either panel can maintain a load of at least about 250 grams without deformation of more than 5% (e.g., no more than about 2.5%, no more than about 7.5%, or no more than about 10%) under about 20 hours or more of use (e.g., about 25 hours of use, about 30 hours of use, or about 50 hours of use). The specifically disclosed exemplary backpacks provided herein fall within this aspect, but many additional containers that are not reflected in the illustrative figures provided herein also are provided by this aspect of the invention. It will also be understood that it may be possible to reverse some aspects of the movement or orientation of various components described herein with respect to a certain direction (up vs. down, top vs. bottom, etc.) without losing desired functionality of the described component, device, or system. Where such variations are possible and functional, they are typically to be considered to be provided herein and within the scope of a more specific disclosure, though in particular aspects the orientation of the invention alternatively may be a required and distinguishing feature or element.

In connection with this exemplary aspects and other aspects of the invention it is important to note that all references with respect to a "vertical" orientation mean with respect to the vertical orientation of the container when at rest on a surface such as the ground and as shown in, e.g., FIG. 1. This vertical orientation also is used in providing references to the "top" and "bottom" of components and compartments and "height" measurements. The perpendicular dimension thereto defines sides and width, with the right side being defined, unless otherwise stated, by the view provided in FIG. 1 (e.g., reference number 100 points to the right side of the backpack in FIG. 1). The other dimension is depth, which is defined by the orientation into and out of the pack. Thus, for example, element 40 is "deeper" in the backpack of FIG. 1 than element 70. It should be understood, however, that in use the part of the container that is functioning as the "top" of the container with respect to the orientation of a user can actually change, in that there are typically multiple points of entry in the container and multiple compartments in the container that can be accessed by such points of entry (often including compartments formed by a transformable divider element), such that the container can be in a vertical orientation as shown but also can be used on its "side" and possibly in other configurations. In fact, this flexibility of the system reflects an important aspect of the devices and systems of the invention as well as the methods of using such systems.

In the transformable divider described previously and elsewhere herein, the top edge of a top panel, and the bottom edge of the bottom panel, typically are, when a transformable divider is operating independently of another transformable divider, fixed in location, such that at the points where they are fixed and attached to the structure of the compartment or, as later described, removable insert device, into which it is incorporated, a pivot point is created. At such pivot points, minimal movement of the top edge of the top panel and the bottom edge of the bottom panel typically occurs, making the position of the edges of the panel substantially constant. Any movement of the panel edges at the pivot point in such aspects is typically due essentially to any flexibility of the design materials used in the panels and pack itself and not due to an intention to create movement at these pivot points of the transformable divider. When more than one transformable divider is present in series with one another in a container of the invention, the bottom panel of a first transformable divider will often serve as the top panel of a second transformable divider, such that any such consistency in the position of the panel edges of each transformable divider will only be maintained if each transformable divider is operated independently of any others.

The container system of the exemplary aspect described above, and of other aspects of the invention provided elsewhere herein, can comprise any suitable number and type of opposing sidewalls, and typically will comprise at least two opposing sidewalls, each sidewall having a top end and a bottom end. The sidewalls can be of any suitable dimensions, the length and width of the sidewalls varying with the nature of the container and its intended use. For example, in a backpack, such as exemplified by the embodiments shown in the figures provided herein, the sidewalls may be about 8 inches (about 20 cm) or longer, about 10 inches (about 25 cm) or longer, about 12 inches (about 30 cm) or longer, about 14 inches (about 36 cm) or longer, about 15 inches (about 38 cm) or longer, about 17.5 inches (about 44 cm) or longer, about 20 inches (about 51 cm) or longer, about 22 inches (about 59 cm) or longer, or even about 24 inches (about 61 cm) or longer.

The material that makes up most of the sidewalls similarly will typically vary with the type of container and anticipated applications. For example, suitable materials for the composition of sidewalls in a backpack are well known in the art. However, in some aspects of the invention, the selection/use/incorporation of a material having particular characteristics in terms of strength, density, flexibility, and/or other characteristics can be important. In one exemplary embodiment, the sidewall is primarily composed of panels made from an elastomeric material, such as ethyl vinyl acetate (EVA), a polyethylene (PE) material, such as a cross-linked polyethylene (CLPE), or combinations of such materials. Particularly advantageous examples of such materials are described further herein. Such materials and other components described herein are often covered with covering materials, such as polyester or cotton canvas or more typically stronger material such as nylon (e.g., "ballistic" nylon having a rating of about 800 to about 1700 Denier, such as about 850 to about 1650 Denier, such as about 1000-1500 Denier) or other strong, typically water-proof or water-resistant fabrics and/or UV-resistant fabrics and often may be treated/coated with other materials such as polyurethane and/or thermoplastic polyurethane to provide improved functionality. The sidewalls may be incorporated into the body material of the container, for example inserted into pocket-like openings in the side of the container so as to secure them and to provide the container with its shape. In such an embodiment, the sidewall may comprise its own covering material or may be inserted into the secured space provided by the external shell material of the storage container such that that external shell material becomes the covering of the sidewall. According to alternative embodiments, the sidewalls may be removable panels capable of being attached or secured in the appropriate position within the storage container. According to such embodiments, the sidewall may comprise its own material covering which is the same as or optionally different from the body material of the storage container.

In some aspects of the invention, such as the one still of primary focus, each sidewall will comprise one or more friction reduction areas or friction reduction components. The friction reduction area(s)/component(s) ("friction reduction area") typically will be located near the top end of the sidewall, the bottom end of a sidewall, or both, and may form most, a substantial majority, substantially all, or even all of the top end, bottom end, or both ends of the sidewall. The friction reduction area of the sidewall can comprise about 10%, about 15%, or about 20% of the total length of the sidewall if present on a single end of a sidewall, or also or alternatively comprise about 10%, about 20%, about 30%, or about 40% of the total length of the sidewall if present on both ends of a sidewall. Specific examples of top end sidewall sections are provided in connection with the disclosed illustrative embodiments reflected in the figures disclosed herein further below. Such figures should be interpreted as exemplary and inclusive of such embodiments wherein the friction reduction area may exist on both the top and bottom ends of a sidewall.

The term "substantially all" when used herein in reference an area or portion of a part, component, or compartment, means at least about 90% (e.g., at least about 92.5%, at least about 95%, at least about 97.5%, at least about 99%, or even at least about 99.5%). A "substantial majority" means at least about 70% (such as at least about 75%, at least about 80%, or at least about 85%).

The friction reduction area/component ("friction reduction area") can be any suitable type of component that reduces the friction between the sidewall and one or more panels of the transformable divider while in movement between the first and second positions that the divider rests in. One example of a friction reduction component/area is an area composed of a relatively low friction material or device/component, such as a low friction polymer that allows the sidewall to "slide" with relatively less force (e.g., at least about 10% less force, at least about 15% less force, at least about 20% less force, at least about 25% less force, at least about 33% less force, or at least about 50% less force) than would be encountered without the presence of the friction reduction area and/or that is experienced outside of the friction reduction area. Examples of such materials are known and include, e.g., polytetrafluoroethylene, or other relatively low friction materials such as polyimide, polylactic acid, polyamide-imide, polyphenylene sulfide (PPS), nylon, acetal (polyoxymethylene), and polyester materials, and other low friction thermoplastic materials. In some embodiments metals may be used or incorporated, such as aluminum. In other aspects, the area can comprise a lubrication means and/or mechanical means to reduce friction, such as rolling bearings. The friction reduction area is typically composed of an area that can be used repeatedly over weeks, months, and ideally years of repeated use without requiring recharging or loading of any kind, such as would be the case with many lubrication solutions and/or use of self-shearing materials.

Typically, and advantageously the low friction area is generated simply by reducing both the thickness of the sidewall panel as well as the width of the sidewall in a part of the path that is traversed by the panels as they move from the first position to the second position (and back again) or by using such a strategy in combination with any of the other approaches described herein or otherwise known in the art for reducing friction. A reduced area of thickness may be accompanied by a reduction in width of the sidewall in the reduced sidewall area, the reduction in width occurring along a slope such that an angled end to the sidewall is created in the area where a transformable divider is moved from a first to a second position. By reducing friction along a portion of the transformation path, a momentum is allowed to build up once most of the panels are in direct alignment/contact (or occasional contact) with the sidewalls, allowing for a detectably easier modulation between the first and second positions than in situations where such a reduce friction component is not in place. Thus, in such embodiments the friction reduction area reduces inertia and/or resistance against such modulation that would be present if the friction reduction area is not present.

Moreover, the presence of the friction reduction area will typically lead to less deformation, such as bowing or distortion of the transformable divider area and/or the sidewalls, thereby preserving the functionality and aesthetic appearance of the section in which the transformable divider is disposed. For example, the inclusion of a friction reduction area can reduce the occurrence and/or the severity of deformation over substantial periods of use (e.g., 5 hours or more, 10 hours or more, 50 hours or more, 100 hours or more, 200 hours or more, 500 hours or more, or 1000 hours or more) and/or over a substantial amount of transformations of the transformable divider (e.g., at least 10, at least 50, at least 100, at least 200, at least 500, or at least 1000 transformations). For example, the inclusion of the friction reduction area can reduce the frequency and/or average size of deformation by at least about 5%, at least about 10%, at least about 15%, at least about 20%, at least about 25%, at least about 33%, at least about 50%, at least about 75%, at least about 100% or more (e.g., 2-fold, 2.5-fold, 3-fold, 4-fold, 5-fold, or more). According to some embodiments, the inclusion of a friction reduction area can reduce the occurrence and/or typical severity of deformation (as measured by maximum amount of deformation or total area of displacement) over substantial use, such as 5 transitions of the transformable divider from a first position to a second position, 6 transitions, 7 transitions, 8 transitions, 9 transition, or 10 transitions or more, such as 15 transitions, 20 transitions, 50 transitions, 100 transitions, 200 transitions, 400 transitions, 600 transitions, 800 transitions, or 1000 transitions or even more of the transformable divider from a first position to a second position. Normal use for a representative user of a device or system comprising a transformable divider might be on the order of about 10 hours or about 10 transitions of the transformable divider from a first position to a second position in a period of 3 months, about 6 months, or about 1 year.

Deformation of components of the devices/systems of the invention in this and other respects discussed herein can mean any visible deformation or a stable displacement of the part/component from the intended position of the part at issue or the other portions of the part by a degree (e.g., by about 2.5 degrees or more, about 5 degrees or more, about 10 degrees or more, about 15 degrees or more, about 20 degrees or more, or even about 30 degrees or more in some cases) or a measure, and deformation can also be described with respect to the amount of the component/part that is deformed (out of alignment as described above) (e.g., if a friction reduction area is present the proportion of a panel that is deformed will typically be limited to about 5% or less of either of the panels, such as about 2.5% or less, about 1% or less, about 0.75% or less, or about 0.5% or less), and/or the likelihood that deformation will occur (e.g., with a friction reduction area the likelihood of deformation can be reduced to about 10% or less, about 5% or less, about 2.5% or less, about 1% or less, about 0.5% or less, about 0.25% or less, about 0.1% or less, about 0.05% or less, or even about 0.01% or less, such as about 0.005% or less or even about 0.001% or less).

According to some embodiments, a reduction in width of the sidewall, described previously as a reduction in width of the sidewall in the reduced sidewall area, the reduction in width occurring along a slope such that an angled end to the sidewall is created in the area where a transformable divider is moved from a first to a second position, may be a reduction of the width of the sidewall in any amount, such as, e.g., an about 0.5% reduction in width up to a nearly or actual 100% reduction in width, whereby the width of the sidewall, from the start to the end of the slope, is significantly or completely reduced such that the end of the sidewall panel becomes very pointed. For example, the width of the sidewall may be reduced by a small amount such as about 0.5%, about 1%, about 5%, about 10%, about 15%, or about 20%, or by a more significant amount such as at least about 25%, at least about 30%, about 35%, about 40%, or at least about 50% or more, such as about 55%, about 60%, about 65%, about 70%, at least about 75%, about 80% or even more, such as approximately 85%, at least approximately 90%, approximately 95%, approximately 99%, about 99.5%, or approximately 100%.

The exemplary container or container section of this and several other aspects of the invention also typically contains one or more dual position transformable divider(s), each comprising a first panel and a second panel connected by a central hinge, the divider being capable of assuming a first position and a second position by applying a force on at least one panel or to the central hinge such that the panels transitionally move about the hinge, the first or upper panel being horizontally oriented in the first position and vertically oriented in the second position and the first and second panels being substantially perpendicular to each other in either position. The panels can be composed of any suitable material, which, like the sidewall, will vary with application. Such materials can be made of hard foams, plastics, metals, cardboard, or lightweight wood, or other relatively stiff ("structural") materials, which may be composed of synthetic or natural polymers, alloys, and the like. Such panels, if comprised of a sensorily hard or solid material, may optionally be covered in a sensorily softer material so as to provide a cushioned surface for stored objects. Such materials used to form the panels may have a density of about 40-about 250 Kg/m3, such as about 30-about 200 Kg/m3, or such as about 50 to 300 Kg/m3 (e.g., about 35-75 Kg/m3, about 37-about 65 Kg/m3, or about 40-about 50 Kg/m3) and/or a tensile strength of about 500-about 3000 KPa, such as about 600-about 2750 KPa, such as about 650-about 2500 KPa, such as about 600-about 2000 KPa or about 700-about 1700 KPa, about 800-about 2600 KPa, or such as about 800-about 2000 KPa (e.g., about 600-1500 KPa, about 650-about 1400 KPa, or about 675-about 1250 KPa, or about 600-about 1000 KPa or about 650-about 1000 KPa). Polymeric foams are often advantageously used to make up most, substantially all, or all of the core material of the panels and/or sidewalls of the section or container. Such materials typically may be classified as open cell or closed cell foams. Closed cell foams, such as a closed cell EVA foam, may provide stronger materials and are advantageously incorporated as primary materials for components (sidewalls and/or panels) in certain aspects of the invention. In some aspects, a substantial majority of a structure may be made up of such a material. In other aspects, substantially all of a structure may be made up of such a material. Still, in other aspects, the entirety or near the entirety (e.g., at least 98%, at least 99%, or at least 99.5%) of a component is made up of the referenced material, such as an EVA foam. In a particular aspect, the core material of the sidewall and/or the panels is a material having the tensile strength, resilience, and/or density of an EVA 45 foam, such as an EVA 45 10T foam.

To further expand on the above, the structural integrity of the storage system, and the structural integrity of its components, can be an important element of functionality. The panels comprising the transformational divider may be primarily composed of an elastomeric polymer board having a width of about 0.5-2 cm, e.g. approximately 0.25-1 cm, or about 0.75-2.5 cm. Various types of polymeric foams may be considered, however to provide both strength and flexibility characteristics required for successful function, the preferred polymeric foam is an elastomeric polymer ethyl vinyl acetate (EVA) foam. Such a foam has a sufficient density, as described previously, so as not to have visibly open cells. The strength of the elastomeric polymer should demonstrate structural integrity characteristics so as to detectably improve upon the structural integrity of the previously sold Atlas Athlete Backpack (Series 1). In the Series 1 pack, panels underwent deformation, such as twisting, bending, folding, curling, and other undesired deformation, with markedly higher rates of occurrence and/or severity (degree), than occur in packs having materials and configurations according to the various aspects of the invention provided herein.

The strength of the elastomeric polymer material utilized in the present invention typically will be least about 10% greater than the material previously used in first generation Atlas Athlete Backpack (Series 1), e.g., approximately at least about 15%, at least about 20%, at least about 30%, at least about 50%, or approximately 75% or more, greater than the strength of the corresponding panel materials used previously. In addition, the density of the elastomeric polymer material utilized in the present invention should be at least about 10% greater, e.g. at least about 15%, at least about 20%, at least about 30%, at least about 50%, or approximately 75% or more, greater than the strength of the materials used in the Series 1 of the Athlete model of backpack. A surprising aspect of the invention is that such materials can be used while still providing desired functionality, which, at least in some aspects, is at least partially attributable to other features of the devices/systems provided herein, such as the reduced friction area and/or the relationship of the panels of the transformable divider system and the sidewalls of the container or other structures of the container or system in which the divider is contained.

The hinge component separating the two panels of the transformable divider can be any suitable hinge that allows the component to rapidly change from the first position to the second position, allowing the two panels attached to it to rotate in relation to one another, while also providing sufficient strength to protect and contain any intended cargo. A hinge can be a mechanical hinge, but more often will be formed simply by a flexible material and/or a seam, such as is exemplified in the illustrative backpack containers disclosed herein.

Each panel of the transformable divider may comprise a central section which is weaker and/or flexible relative to the other portions of the panel. This weaker/flexible point, being approximately 5%, approximately 10%, approximately 15%, approximately 50%, approximately 75%, or approximately 90% weaker than other portion of the panel, in terms of its movement in reaction to force as compared to other parts of the panel, allows for some amount of reversible bending and/or compression about the central portion during movement between the first and second positions (desirably with little or no deformation in the panel other than this reversible bending, at least over a number of transformations, such as at least about 10 transformations, at least about 30 transformations, at least about 100 transformations, at least about 250 transformations, at least about 500 transformations, or at least about 1000 transformations). Such a weaker/more flexible point feature may be created using a mechanical hinge, a reduction in density and/or thickness of the panel, or other means for providing a relatively weaker area, and is commonly created using a seam, alone or in association with such other weakening features, such as a stitched seam, placed across the panel, which is often further advantageous by simultaneously serving to bind the panel covering (e.g., a nylon covering) to the material making up the panel core (e.g., a board composed of an EVA foam). In this manner a weaker/flexible point is created and the material comprising the inner core is physically connected to its cover material, preventing the inner core from sliding and repositioning relative to its cover material. This weaker/more flexible section may be placed at any point along the height of the panel running horizontally across the panel, for example one quarter of the way up the panel from the bottom, one third of the way up the panel from the bottom, placed at the midpoint of the panel, placed three quarters of the way up the panel from the bottom. However most often the weaker/more flexible section will be formed at or near the midsection of the panel.

The transformable divider typically is positioned within a larger storage space so as to be able to reconfigure that space when in varying conformations. The panels of the transformable divider may be positioned relative to the side walls of a larger space (e.g., a primary or large cargo compartment). To maintain structural integrity, at least half (e.g. about 50%, about 60%, about 75%, about 80%, about 95%, or even 100%) of the upper panel of such a transformable divider, and the entirety of the lower panel, will often rest below the top end of the side walls when the transformable divider is configured in the second position. The design of the outer side wall of the container typically will dictate how effective any percentage of the upper panel being above the sidewall will be, as it may influence how easy or how difficult it may be to reconfigure the transformable divider from one position to another.

The panels comprising the transformational divider may comprise a support material that has a strength such that either panel can maintain a load of at least about 250 grams (e.g. about 250 grams or more, about 300 grams or more, about 500 grams or more, about 1 kilogram or more, about 3 kilograms or more, about 5 kilograms or more) without deformation of more than 5% (e.g. 0.5% deformation, 1% deformation, 3% deformation, 4.5% deformation) and/or without deformation of 20 degrees or more, 15 degrees or more, 10 degrees or more, or even 5 degrees or more, a significant amount of the time (e.g., at least about 80% of the time, at least about 90% of the time, at least about 95% of the time, or even at least about 99%, 99.5%, 99.9%, or 99.99% of the time) under 5 or more hours of use, such as 7 or more hours of use, 10 or more hours of use, 15 or more hours of use, 20 hours or more of use (e.g., about 25 hours of use or more, about 50 hours of use or more, about 100 hours of use or more, about 200 hours of use or more, about 500 hours of use or more, or about 1000 hours of use or more) and/or over the course of a number of panel transitions, such as 5 transitions of the transformable divider from a first position to a second position, 6 transitions, 7 transitions, 8 transitions, 9 transition, or 10 transitions or more, such as 15 transitions, 20 transitions, 50 transitions, 100 transitions, 200 transitions, 400 transitions, 600 transitions, 800 transitions, or 1000 transitions or even more of the transformable divider from a first position to a second position. According to what may be considered normal use for a representative user of a system comprising a transformable divider, about 10 hours of pack use or also or alternatively about 10, about 20, about 30, about 50, or about 100 transitions of the transformable divider from a first position to a second position may be considered average use over the course of a year, which may define a period for sustaining material, resisting deformation, and the like, according to embodiments described herein.

Typically, the panels of the transformational divider, when in either the first or second position, create what may be described as a "box" by the fact that the two panels exist in relation to one another at or near right angles.

Across multiple packs, that is, across the line of manufactured packs or a collection of manufactured packs, such as in the numbers described above or more (e.g., at least about 200 packs, at least about 500 packs, at least about 1000 packs, at least 2000 packs, at least 5000 packs, at least 10000 packs) incorporating the invention described herein, the storage section defined by the transformable divider is able to hold its shape such that less than about 15%, less than about 10%, less than about 5%, less than about 2%, or even less than about 1% of transformable dividers in such packs after about 5, about 7, about 10, about 15, about 20, about 40, about 60, about 100, about 200, about 300, or even about 500 hours of use exhibit deformation of more than about 5%, more than about 4%, more than about 3%, more than about 2%, or even more than about 1% and/or less than about 20 degrees maximum, less than about 15 degrees maximum, less than about 10 degrees maximum, less than about 7.5 degrees maximum, less than about 5 degrees maximum, or even less than about 3 degrees maximum. The panels comprising such a support material such as described previously may retain its structural integrity such that after such use, substantially all parts of the first panel remain in a substantially perpendicular position to the second panel.

In one aspect, the invention provides containers and systems as described herein, comprising a dual position transformable component (divider), comprising two panels, wherein one panel or each panel may comprise a cushion layer that reduces damage to cargo contained within one or more of the spaces formed by the transformable component. In a specific aspect, at least one of the cushion layers reversibly compresses at least about 25% in depth (e.g., at least 35% in depth, at least 40% in depth, at least about 50% in depth, at least about 65% in depth, at least about 75% in depth, at least about 90% in depth, or even about 100% in depth) when contacted with a force equivalent or greater to placement of an object of at least about 375 grams (e.g., about 400 grams or more, about 500 grams or more, about 750 grams or more, about 1000 grams or more, about 1500 grams or more, or about 2000 grams or about 5000 grams or more).

In one aspect, the entire system or container provided by practicing the invention, including the transformable divider and related system (s), is rated for containing at least about 10 pounds of cargo, at least about 15 pounds (about 7 kg) of cargo, and more typically will be rated for containing at least about 25 pounds (about 11 kg) of cargo over sustained periods of time, such as about 30 pounds (about 14 kg) or more, about 35 pounds (about 16 kg) or more, about 40 pounds (about 18 kg) or more, or even about 50 or more pounds (about 23 or more kg) of cargo over about 10 or more, about 15 or more, about 25 or more, about 50 or more, about 100 or more, about 250 or more, about 500 or more, or about 1000 or more hours of use (e.g., a year of use for an average user, 18 months of use for an average user, about 2 years of use for an average user, or about 2.5 years of use for an average user).

In one aspect, the sidewalls of the container, much like the panels of the transformable divider described above, may also or alternatively comprise a cushion layer. In one aspect, the cushion layers of the sidewall are configured such that the sidewall cushion layer is in direct or indirect contact with the side of at least one panel when the panels are in the first or second position. In preferred embodiments, the cushion layer of the transformable divider and the cushion layer of the sidewalls are both oriented toward the interior of the storage system.

A cushion layer for use in the above-described aspects can be composed of any material that provides the desired level of cushioning. The cushion layer will typically be softer and yet will often be more resilient to compression than other materials, such as the core material of the panels (e.g., for the sidewall core and/or panel core). Thermoplastic materials, such as polyurethanes, compressed polyester materials, and the like, which typically are compressed and/or in open cell configuration can be used to provide a cushion layer. The cushion material often advantageously is primarily composed of, substantially composed of, substantially all composed of, or entirely composed of a polyethylene (PE) foam or a foam formed of a material that provides substantially similar performance characteristics. The cushion layer can have any suitable dimensions. The cushion layer typically will be substantially thinner than the core layer of the sidewall and/or panel core that it is associated with. A cushion layer typically will be positioned between at least one side of such a core and a covering material, such as a nylon covering, as described elsewhere herein. The cushion layer typically is oriented towards the interior of the container (the cargo area) in the sidewalls and/or the panels, preferably on both (and often the opposite side of such materials will lack any cushion component/member/area). A sometimes advantageous material for a cushioning material is a PE 5T foam or a foam providing similar functioning in terms of cushioning, resilience, thickness, density, and/or weight.

In one embodiment of the present invention, a container comprises a transformable divider comprising an upper and a lower panel, each of the panels being less than about 5 inches in height (e.g. about 5 inches (about 13 cm), about 4.75 inches (about 12 cm), about 4.5 inches (about 11 cm), about 4.25 inches (about 11 cm), or for example about 4 inches (about 10 cm) in height).

In some facets, such as the one still of primary focus, the invention provides a section or a container comprising a transformable divider further comprising an upper and a lower panel which are substantially the same length and width. For example, the length of the upper and lower panels of the transformational section may not, according to embodiments, vary by more than about 5%, for example about 5%, about 4%, about 3%, about 2% about 1%, or even are identical in length, and the width of the upper and lower panels of the transformational section do not vary by more than 5%, for example about 5%, about 4%, about 3%, about 2%, about 1%, or even have identical widths. In a particular illustrative embodiment, the upper and lower panels of the transformable divider are approximately 4 inches (about 10 cm) in height, e.g., about 1-about 5 inches (about 3-about 13 cm) or about 1.5-about 4.5 inches (about 3.8-about 11.4 cm), or about 2-about 4.25 inches in height (about 5-about 10.8 cm in height) and approximately 9 inches (approximately 23 cm) in length, e.g., about 6-about 24 inches (about 15-about 61 cm) in length, such as about 8-about 18 inches (about 20-about 46 cm) in length, such as about 8-14 inches (about 20-about 36 cm) in length or about 8-12 inches (about 20-about 30 cm in length).

As already indicated, a transformable divider component of the systems and containers of the invention typically may be configured in a first or a second position upon the application of a sufficient force. A sufficient force typically will be a force that is equivalent to the level of force exerted by an average healthy person of about 7 to about 70 years of age when pushing or pulling in a relaxed manner or at least typically without significant exertion. In some cases this range will increase to e.g., about 5 to about 80 years and in other cases it may narrow to, e.g., about 10 to about 65 years of age.

Repositioning the divider from the first to the second position typically requires moving the panels of the transformable divider across the surface of the container side wall or similar surface/structure. Contact with the container sidewall provides both stability and separation of storage compartments, however the componentry of the side wall may create restrictions in movement of the transformable divider when the user is attempting to reposition the transformable divider from a first to a second position. In one exemplary aspect of the invention, an area of reduced friction between the edges of the transformable divider and the sidewall of the container is formed by an area of reduced sidewall thickness. The thickness of the sidewall, on its upper end, lower end, or both ends according to the presence or absence of a transformable divider adjacent to it, is reduced at least about 20% or at least about 25%, e.g. about 25%, about 30%, about 40%, about 50%, for example about 60%, about 75%, about 80% or in some embodiments the reduction is up to about and may even about 100% reduction of thickness (e.g., an at least about 90%, at least about 95%, or at least about 99% reduction) in the reduced thickness area. The reduced thickness area typically is at least about 1 inch in length, for example about 0.05 inches, 0.1 inches, 0.25 inches, 0.5 inches, about 0.75 inches, about 1 inch, for example about 1.25 inches or about 1.5 inches, or approximately 2 inches, but in containers of different sizes the reduced thickness area can be proportionally sized to the container. This principle is true with respect to any of the specific length, width, and height measurements provided herein as such specific measurements are often provided for illustration or are made with respect to sometimes preferred aspects, such as containers configured for backpack use. For example, if a disclosure of a first component herein is about 1 inch (about 3 cm) in length and is provided in relationship to another component that is about 10 inches (about 25 cm) in length, it should be understood that the invention provides a device/component/system comprising corresponding components of different sizes but that still have the relationship of an about 1 to about 10 ratio in length. The reduced friction area will in certain embodiments have a maximum length of about 2 inches (about 5 cm), for example 1.5 inches (3.8 cm), 1.75 inches (4.4 cm), 2 inches (5 cm), or approximately 2.25 inches (5.7 cm) or up to about 3 inches (8 cm), for example about 3.25 inches (8.3 cm). Thus, the reduced friction area may be about 1-3 inches (about 3-8 cm), such as about 1.25-about 2.75 inches (about 3.2-about 7 cm) in length. This reduced sidewall area may be reduced along a slope, the slope depending on the chosen and required length of the width reduction area. Such a slope creates an angled end to the sidewall. The reduction in the width of the sidewall area may range from about 5% to about 70%, for example about 3%, about 20%, about 50%, about 70%, e.g. about 75% or for example up to 100%.

According to embodiments wherein the reduced thickness area is an area where the thickness is reduced more than 50%, for example reduced to an extent approaching about 60%, about 70%, about 80%, about 90%, or approaching or reaching about 100% or 100%, additional support elements may be desirable to incorporate in order to maintain the structural integrity of the pack. Such support elements may include bars, frames, hard corner pieces made of metal, plastic, wood, or appropriately structured foam or the like, which may be present as bars, pads, webs, etc., such that the ability to move a transformable divider from a first position to a second position is not restricted yet the structural integrity of the sidewalls and the overall structural integrity of the storage container is maintained.

The length of a friction reduction area that comprises an area of reduced thickness as one means, the primary means, or only means of reducing friction in a device or system of the invention, may be consistent in its length or may vary across its span and/or the span of the sidewall (e.g., the friction reduction area can be triangular or trapezoidal in shape). For example, in one aspect the first length of the friction reduction area may be at least about 10% greater than its second length, for example the first length can be at least about 25% greater, at least about 30% greater, at least about 40% greater, at least about 50% greater, at least about 75% greater, at least about 85% greater, for example 90% greater or even 100% greater than its second length (e.g., at least about 1.5× greater, at least about 1.75× greater, at least about 2× greater, at least about 2.5× greater, at least about 3× greater, at least about 4× greater, or more than about 5× greater).

In one aspect of the invention, a container comprises a transformable divider, which further comprises two panels, an upper or first panel and a lower or second panel, each of which can in some cases be further divided into an upper or first subpanel and a lower or second subpanel by a weak point (such as those previously described), most often embodied as a partial hinge made by a seam imposed in a central portion of the panel(s). In one aspect of the invention, the top or first subpanel and the bottom or second subpanel have approximately the same height and when the transformable divider is in the first position, the sides of the bottom or second subpanel of the larger upper panel are in closer proximity to the sidewall than the top or first subpanel of the larger upper panel.

One facet of the invention is such that the container previously described, housing such features as the transformable divider and other features to be described below, comprises an outside frame wherein the sidewalls are formed by separate parts. That is, each left and right sidewall of the larger container is a separate piece of construction, not a continuation of a wall serving as the bottom of the container. In some embodiments, the sidewalls may comprise a central line of stitching to provide some, though limited, flexibility to the side wall or to ensure that the cover material of the sidewall core cannot move about the sidewall core material. In other embodiments, the sidewalls may not comprise a central line of stitching so as to maintain a high level of structural integrity.

In some aspects of the invention the position of the exterior ends of the panels facing the sidewalls and the interior end of the sidewalls remain in a substantially constant position in the first position, second position, and during transition, such that the distance between and/or contact between these components varies by no more than about 10%, no more than about 5%, no more than about 3%, no more than about 2%, or even no more than about 1%.

In some facets of the invention, wherein a transformable divider sits within a storage compartment of a larger storage system, the transformable divider includes a sidecover component. This sidecover component may be made of any type of flexible material which may provide a separation between a front side and a back side of the transformable divider and may flex in such a way as to provide movement of the transformable divider between a first and second position. Such a flexible material may be a solid cloth or synthetic material, an elastic fabric (e.g., a nylon), a screen or mesh fabric, or other materials with similar characteristics or can be made from a combination of such materials. The sidecover component material may be the same as the panel covering material, the material comprising the body of the storage container, or a material not used for either of those components. Also or alternatively the material used may be a combination of one or more materials so as to design a sidecover which achieves a desired aesthetic appearance. The sidecover component may be connected to the exterior ends of panels such that when in the first position the sidecover component stretches to cover the area forward and down from the first panel, in front of the second panel, and adjacent the sidewall. The sidecover in this position serves to define and maintain the container space between the interior of the "box" created by the transformable divider and the space that exists beside or behind it within the larger storage system. When in the second position, the sidecover typically stretches to cover the area behind and outward from the ends of first panel, above and upward (in a backward direction) from the second panel, and adjacent to the sidewall. In a system where a transformable divider may not be positioned directly adjacent to a sidewall of the larger storage system, the sidecover can still serve a similar purpose; however it may be oriented differently to a sidewall than as described above. Whether in a system where the transformable divider is positioned directly adjacent to a sidewall or where a transformable divider is positioned directly adjacent to another transformable divider or alternatively is adjacent to empty space within a storage compartment, the sidecover, when the transformable divider is in either the first or the second position, will typically run substantially parallel to a top or bottom, left or right sidewall, of the larger container or storage space, and will serve to enclose the sides of the box container or other shaped container area created by the transformable divider in either its first or second position.

One facet of the invention includes the incorporation of a feature to facilitate the transition of the transformable divider between the first position and the second position. Such a repositioning from a first position to a second position requires the application of a force, typically a pull force, push force, or commonly both (a pull force used to move the transformable divider into one position and the push force or an oppositely oriented pull force being used to place the transformable divider in the opposite position). A pull force may be applied through the use of a handle or other pull-facilitating structure that is attached, in one embodiment, to the central hinge between the first and second panels of the transformable divider (the device may include one such handle or several handles). Such a feature may also be a tab, a loop, a finger hold created by a hole or a pocket or a deformation such that it allows the user to hold onto or connect to the transformable panel in order to pull it from the first to the second position. The pull force required to reconfigure the transformable panel from a first position to a second position is approximately 100 N to approximately 300 N, for example approximately 50 to approximately 200 N, approximately 75 to approximately 250 N, approximately 150 to approximately 310N, or approximately 200 to approximately 350N. In other cases, the pull force can be defined by the average pull force exhibited by a typical user (e.g., the typical pull force of a healthy person of between about 9 and 72 years of age). Where a minimum push force is used for achieving some or all configuration changes in a device/system of the invention it will be of a similar magnitude to such above-described pull force requirements.

One embodiment of the present invention includes a container as described previously which functions as a removable/insertable core, capable of being inserted into and or removed from one or more larger storage containers, also referred to as a "master" container, and which together can be considered to form a master container system. In some embodiments, a removable core device of the invention, comprising one or more transformable dividers, may optionally operate independently of the master container, having its own carrying mechanism or mechanisms and operability features, while also maintaining its ability to integrate with the larger storage container. The features and components of the removable core may operate cooperatively with the larger container when the two containers are used in concert; that is, when the removable core has been inserted into the larger container. In one embodiment, when the removable core is inserted and in place within the master container, the upper panel of a transformable divider component of the removable core may align with the upper panel of a transformable divider component of the larger storage system to create a relatively flat, relatively uniform platform serving as a wall or bottom to a storage space created by the two components working in concert. The removable core may be inserted freely or in some embodiments may slide into the larger container via a track system. In some embodiments a removable core device also or alternatively may attach to the larger container through attachment means, such as hook-and-loop attachments, buttons, tension bands, snaps, belts, or combinations of any thereof. In some embodiments the removable core may be positioned in only one configuration within the larger system. In alternative embodiments, the removable core may be used in multiple configurations within the larger system. In some embodiments, there may be only one access point in which the removable core may be inserted into the larger system. In alternative embodiments, there may be multiple access points in which the removable core may be inserted into the master system. In some embodiments, the removable core, upon insertion into the larger system, may be mechanically attached to the larger system. In alternative embodiments, once inserted the removable core may maintain its position by simple friction and tightness of fit within the larger system.

A master container that is used in a system with one or more removable cores each comprising one or more transformable dividers, optionally may include at least one protective covering, at least one additional container compartment (e.g., one or more pockets or other accessible container areas), at least one transport-facilitating apparatus (e.g., wheels, handles, or the like), or a combination of some or all thereof; and will usually comprise at least one container receiving section that is adapted to receive and stably maintain a reversibly partially transformable container and to allow operation of the transformable divider when the reversibly partially transformable container is contained therein. In some aspects the invention provides kits which can be used to transform other containers to be adapted to receive a removable core or a core that is permanently implanted into the container. In some aspects, the invention provides a method of modifying a potential master container, such as a luggage item, such as a backpack, comprising sizing a removable or implantable core and otherwise configuring/adapting the core and/or the container for stable insertion or placement of the core into the master container. In other cases, the master container and the core are co-manufactured and/or co-designed, with the intent of some of the parts of the system operating with each other on manufacture, without the need for post-manufacture modification.

The devices of the invention can be adapted for use as different types of containers suitable for different types of applications. Such uses and applications may include providing containers that act as boxes or crates for the storage of materials. However, more commonly anticipated uses include portable storage containers and/or luggage containers such as purses, satchels, bags designed for specific applications such as computer cases or camera bags, or carrying devices, such as backpacks. In one embodiment, the device is a backpack. In one embodiment, the invention provides a backpack that comprises a removable core having the transformable divider of the invention. In one aspect, such a removable core is configured so as to fit easily within most airplane carry-on (e.g., overhead luggage) container and optionally includes typical luggage elements such as one or more carrying straps to support and/or secure the core on the body, additional compartments, such as zip pockets, structures for holding identification, and protective outer coating, which may be waterproof or water resistant and/or UV resistant.

The container previously described in any embodiment above, having a transformable divider which separates one compartment of a storage system from another, may provide further functionality to the user by incorporating multiple access points to multiple storage sections within the associated/larger container. Such access points may be such that they are always open, for example provided by a flap system, or selectively opened, e.g. through use of closures including zippers, snaps, hook-and-loop (e.g., Velcro®) systems, magnets, and the like. In one such embodiment, an openable enclosure is positioned above a transformational divider and may be directly or indirectly attached to the transformable divider. The openable enclosure utilizes a zipper. When closed, the user may access the storage area in front of or facing the user. When open, the user may access not only the storage area in front of or facing the user, but the storage compartment behind the transformable divider. In order to maintain structural integrity and smother operability of both the transformable divider below such an opening, a preferred design is such that the attachment to the transformable divider is to the interior top of the first panel of the transformable divider such that the openable enclosure panel remains substantially flush with the exterior of the first panel.

One facet of the invention is the use of multiple transformable dividers, the transformable dividers having been previously described. Such multiple dividers may exist within the same or a multitude of compartments, sections, or storage areas within a single storage system. Such multiple transformational dividers may be used in series. Dual position transformational dividers, for example, may be positioned in contact with one another, such as in a stacked position relative to one another.

In a configuration in which two transformable dividers are positioned adjacent to one another the second transformable divider can be configured such that the bottom panel of the first transformable divider simultaneously serves as and operates as the top panel of the second transformable divider and is further connected to a third panel, serving as the bottom panel of the second transformable divider. When transformable dividers operate in such a series, the interface between the bottom panel of the first transformable divider and the top panel of the second transformable divider is a hinge. This hinge is a central hinge as previously described; functioning to connect a first or upper and a second or lower panel of a transformable divider.

When two transformable dividers are used together in such a stacked manner, often three total panels exist. The first, attached at its top edge to the outer edge of a top, bottom, or side wall of the storage container and its bottom edge to the top edge of a second panel, separated by a central hinge as previously described. The bottom edge of the second panel is connected to the top edge of a third panel, separated by a central hinge. Where the series of transformable dividers stops at two, the bottom edge of the third panel is attached to a floor or wall perpendicular to the top, bottom or side wall of the storage container to which the top edge of the first panel is attached. A mechanism to pull the transformable divider from a first to a second position is attached to each central hinge. One configuration using this type of design is such that the first panel is horizontally oriented and the second and third panels are vertically oriented, such that the largest storage capacity in the compartment facing the user is created. A second possible configuration in this type of series embodiment is that the first transformable divider is pulled from a recessed position, position 1, into an extended position, position 2. The first panel is now vertically oriented at a right angle to the second panel which is now horizontally oriented. A third configuration possible from this configuration is one where the second transformable divider, comprising the second panel and the third panel, is pulled into an extended or second position. In this configuration, the first and second panels are now in vertical orientations, and the third panel is in a horizontal configuration. In this configuration, minimal space is allocated to the storage compartment facing the user, and maximum space is allocated to the storage compartment behind or on the back side of the transformable divider.

A further embodiment of transformable panels in a stacked series is to continue to stack the transformable dividers beyond a series of 2, wherein the bottom panel of one transformable divider continues to operate as the top panel of a transformable panel below it, separated by a central hinge and each having a pulling device or mechanism positioned near its central hinge. In this way, one creates the ability to create a "wave" effect, in that any consecutive transformable divider along the series may be pulled into an extended or secondary position.

Yet another embodiment of the current invention is the use of multiple transformational dividers, positioned next to each other not in a stacked manner as described above, but in an orientation such that the edges of the upper and lower panels comprising one transformable panel, and the side cover component of the transformable divider, is adjacent to the side cover component and panel edges of a second transformable divider. In this embodiment, each transformable divider operates independently and maintains separate space from the space created by any transformable divider positioned next to it by its side cover component.

One aspect of the invention is embodied in a container divider capable of forming a stacked configuration, a linear configuration, or a number of intermediate positions due to the ability of at least three panels of such a divider to be able to rotate about 360 degrees around one or more double hinges. Such a stackable-linear-rotational divider, also referred to herein as an SLR divider, may be optionally incorporated into the container systems described herein, may be used with or without any other previously described divider elements. One or more SLR divider systems may be incorporated into a single storage system.

The SLR divider comprises a minimum of three interconnected panels. Such panels may be made of any material with enough structural integrity so as to be able to maintain its shape when positioned on its edge and connected to ether a wall of the storage container of to another panel of the divider by the double hinge described below. For example, such materials may include foams, plastics, wood, paper/cardboard or other natural or synthetic material known to the art. In the preferred embodiment, the core of the SLR divider panels is made of an elastomeric material. As the panels serve as dividers defining storage sections intended to hold a wide variety of items, a padding or cushioning layer may be included in the panels so as to provide shock absorbance capability, further protecting objects being stored and held by them. Such padding may include a softer foam, cloth, felt, cotton, thick fabric, or other synthetic or natural cushioning element. The inner core material of the SLR divider may be covered in or coated with a water-resistant or water-proof and tear resistant material such as a polyurethane laminate (PUL), thermoplastic polyurethane (TPU), a nylon fabric, laminated cotton, oil cloth (also known as enameled cloth), polyester fabrics, vinyl, plastics, pleather, leather or other such water resistant and materials.

The panels of the SLR divider are connected by one or more connecting hinges that allow each of the panels to move approximately 360 degrees about the hinges. Such hinges must allow panels to reposition relative to one another, so may not be traditional mechanical hinges or any hinge which physically attaches one panel to another. A mechanism distinct and separate from the panels themselves must be used in order to obtain the necessary freedom of movement of the panels relative to each other. Such a hinge may be created through 2 sets of interwoven strips or ribbons. Such strips may be ribbons, strips of fabric, rope, string, strapping or the like. In the preferred embodiment, ribbon-like strapping is used. The mechanism for creating the double hinge is described below.

One facet of the SLR component of a storage container is the incorporation of a stabilization component on or within the SLR that allows for the SLR to connect at least some of the panels of the SLR to a corresponding material, e.g. the lining material of the walls of the storage container. Such a material may be magnetic in nature. Alternatively, such a material may be one component of a hook-and-loop (i.e. Velcro®) type connection mechanism. In the preferred embodiment, a hook-and-loop connection mechanism is used for stabilization. In the preferred design, each edge of the panel comprising the SLR contains a section of hook material representing at least 5%, for example 10%, about 20%, about 40%, about 60%, about 80%, or about 100% of the edge of the panel. When the panels interact with one another, the hook sections of each panel edge simply make contact but do not connect. However, when the edge of a panel makes contact with a wall of the container lined with a material having a loop component, the hooks of the SLR edge connect with the loops of the wall, creating a stabilization of the SLR. Alternatively, a magnet system or other similar system which offers 2 differing forces or mechanisms for connecting may be used.

The panels of the SLR divider interact with one another about a hinge. The hinge is more specifically a double hinge. The first type of hinge is formed by multiple pieces of a first ribbon or an equivalent component (in function—e.g., string or line) which are connected to a central portion of one end of at least two panels. The second type of hinge is formed by a left- and a right-side set of ribbons positioned at the outer ends of at least two panels. No overlap exists between the ribbon of the first hinge and the ribbons of the second hinge as they collaborate to connect the panels within the divider.

The double hinges of the SLR system allow the panels to swing approximately 360 degrees relative to one another and to reposition themselves in relation to other panels along the series of panels. This allows SLR to be highly reconfigurable. The double hinges allow the panels to be fully stacked one-on-top-of the other, to be fully extended in series, or to create a multitude of formations and shapes in between, including having panels which extend perpendicular to or at substantially any angle between 0 and 180 degrees from panels positioned above or below it. The double hinges of the SLR additionally provide the ability to form a four-panel junction in which each panel is perpendicular to two other panels and aligned with another panel, separating the current SLR from other rotational systems. The reconfigurability of the SLR provides for a method of storing materials in containers by wrapping (configuring) the SLR around the stored item.

A single SLR system may comprise any number of panels greater than or equal to 3. In a typical embodiment a single SLR would have 3 to 12 panels, more typically 3-10 or 4 to 10 panels, often e.g., 3 to 6, 3-7, 3-8, 3-5, 4-8, 4-7, 4-6 or 4-5 panels. The number panels may be influenced by the targeted functionality of the storage container with which it is to be used, for example the desire to store a number of items within a single compartment may benefit from use of an SLR having a higher number of panels as compared to a requirement to store only a few items within a single storage compartment. The number, size, and shape of items to be stored may benefit from SLRs having a varying number of panels. As such the length of a single SLR system may vary depending on how long or large an SLR system is desired. The maximum SLR system length will be limited by the amount of space in the storage compartment in which it will reside, as increasing the number of panels will not only increase the length of the SLR but will also take up more space in the storage compartment, reducing the storage space available for other stored items. A standard SLR system may range from about 12 inches (about 30 cm) in length for a very small compartment up to approximately 6 feet (approximately 1.8 m) for a larger compartment. The average SLR divider is approximately 8 to 36 inches (approximately 20 to 91 cm) in length, approximately 6 inches (approximately 15 cm), about 10 inches (about 25 cm), about 20 inches (about 51 cm), about 36 inches (about 91 cm), about 40 inches (about 102 cm), or approximately 42 inches (about 107 cm) in length.

The panels of the SLR system should be of sufficient height so as to maintain stored items in place during any type of transport. As such, the height of the divider, alternatively identified as the width of the panels of the SLR, should represent approximately 50% or more the of the depth of the storage container or section in which it is positioned. Under most conditions, the SLR divider should be between about 2 and 12 inches (about 5 and 30 cm) in height, that is approximately 3 inches (approximately 8 cm) in height, about 4 inches (about 10 cm), about 6 inches (about 15 cm), about 8 inches (about 20 cm), about 10 inches (about 25.4 cm), about 12 inches (about 30 cm), high.

The SLR divider, its panels, and the material comprising the panels must provide sufficient structural integrity so as to be able to maintain objects safely and securely over a period of time without compromise. In one embodiment, the SLR divider may maintain a stored item of at least 250 grams, for example about 250 grams, about 300 grams, about 400 grams or about 450 grams for a period of at least 20 hours, for example at least 20 hours, at least 40 hours, at least 80 hours, or at least about 100 hours, at least about 500 hours, or at least about 1000 hours without underdoing a deformation in shape of more than about 10%, for example about 1%, about 2%, about 5%, about 8%, about 12%, or about 15%.

It will be clear from the preceding that often the SLR divider operates in a classic "Jacob's ladder" style and can assume a "Jacob's ladder" configuration in use. The application of such engineering to such containers, particularly in combination with a device for attaching two or more parts of a Jacob's ladder SLR to a larger container, such as a backpack, is new; however, the principles described above can be modified or replaced with others to provide similar functionality (ability of panels to move about 360 degrees with respect to each panels, such as about 320, about 330, about 340, or about 350 degrees with respect to each other). For example, the strategies described in U.S. Pat. No. 5,628,670, which provide alternatives to the classical Jacob's ladder approach, may also be used to provide similar functionality in an SLR component of the invention.

A single SLR component may be utilized alone within a larger storage container. Also or alternatively, multiple SLR components may be attached to one another to create a longer SLR system. Further, multiple, separate SLR systems may be used simultaneously though independently within the same larger storage system.

Containers of the invention can be any suitable types of containers with respect to containing and working with one or more of the novel dividers or divider systems provided herein. In one aspect, the containers are luggage items. In other aspects the containers are backpacks. However, the inventive dividers also can be used with other types of containers, ranging from dresser or other household or office drawers, desks, tool boxes, glove compartments, lunch containers, notebooks, pouches on bikes or strollers, and toy boxes, just to provide a few examples.

In one aspect the invention provides new systems comprising a transformable divider for use in a container, such as a backpack, which provides a user with options for separating items within a pack and re-allocating space from one compartment of a pack to another while securely retaining such content in the preferred, separated positions. Containers of the invention typically are manually transportable, though the various aspects of the invention could be applied to even larger containers. The transformable divider may exist alone, in series with a second, third, or more transformable divider(s), or the transformable divider may exist along with others of the same or different sizes within but not contiguous with one another. The transformable divider may reside within a defined storage section of a backpack, the storage section having opposing sidewalls, a top end and a bottom end.

A transformable divider, or multiple transformable dividers, allow the user to change the internal storage compartment space allocation within a container, such as a backpack, by creating a reconfigurable wall between two separate, reconfigurable compartments of the section in which the divider is positioned. The transformable dividers typically modulate upon the application of a force, typically a manual force, such as a pushing and/or a pulling, such as a moderate pushing and/or pulling force of a typical adult (e.g. applying a force less than required to move an about 7.5 pound (about 3.4 kg) weight, usually a force less than required to move an about five pound (about 2.3 kg) weight, and generally less than required to move a weight of about 3 pounds (about 1.4 kg), about 2 pounds (about 0.9 kg), or about 1 pound (about 0.5 kg)), between two final configurations. In one aspect, an exemplary divider comprises two panels connected by a hinge component, which permits the dividers to reconfigure from a first position to a second position, both positions maintaining the dividers in a perpendicular relationship to one another.

Illustrative Embodiments Shown in the Figures

In the following sections reference will be made to the figures provided herewith, which disclose exemplary backpacks and components for use in backpacks. Although such specific embodiments may have inventive differences from the broader scope of some of the aspects of the invention, the provision of them herein, as well as the figures and any description of aspects in connection with such figures, should not be construed as limiting the scope of the invention.

In a first exemplary aspect of the invention, the first configuration of a transformable divider typically is a relatively recessed position aligned with the back and parallel to top of the overall container (see FIGS. 1 and 2), such that the storage capacity of the largest storage section from which the transformable divider is being viewed is maximized and the top of the transformable section forms the bottom of a smaller top container area. This state/configuration is achieved by the placement of a first panel (top panel) of the divider (the divider closes to the top of the container or container section) being in a horizontal orientation and position (with respect to the orientation of the container as described above) and a second panel (bottom panel) of the divider (the divider closest to the bottom of the container or container section) in a vertical orientation and position (with respect to the orientation of the container, which has its greatest dimension in a vertical orientation), such that it is substantially in alignment with the backwall of the cargo compartment. This orientation increases the size of any cargo compartment the top (or bottom of which) is formed by the transformable section (on the interior side), and correspondingly decreases the open area formed on the opposite side of the transformable section. The second configuration/position can be considered an "extended" or elevated position (FIG. 3), wherein the storage capacity of the storage section from which the transformable divider is being viewed is reduced; the maximum storage space that is covered by the transformable divider having been shifted to the storage compartment behind or abutting the originally viewed storage compartment, where the transformable divider would appear to be in the recessed position. This "origami" compartment functionality was generally also embodied in similar structures contained in the Series 1 Atlas Packs. However, as described elsewhere herein and further below, the operation and features of the containers shown in these Figures differ from such packs in several structural and operational characteristics.

The components of a typical transformable divider element of the systems of such aspects of the invention are exemplified in FIG. 1. The transformable divider (10) comprises two main panels positioned at about 90 degrees to one another (e.g., within 1-5 degrees, typically 1-3 degrees, and more typically within 1 degree or less of perpendicular to each other); an upper, or first (20) and lower, or second (30) panel, in contact with and connected to each other along one edge and also or alternatively being connected to one another along that edge by a central hinge (40). A pulling mechanism such as a loop handle (50) typically is incorporated and can be used to aid the user in pulling the transformable divider from the recessed to the extended position is affixed to the central hinge. In the exemplified embodiment shown in FIG. 1, the flexible hinge is created by a seam that is placed between the first and second panels. The shape of the upper and lower panels are substantially the same, the areas for which varying by no more than about 5%, such as no more than about 4%, no more than about 3%, no more than about 2.5%, no more than about 2%, or no more than about 1% (or even no more than about 0.5%). The transformable divider lies substantially within a storage compartment (60) having opposing side walls (150), a top (230) and bottom (240) end, and, when in varying configurations, alters the storage space of the storage compartment. According to certain embodiments, no more than 50% of the upper panel may reside above the top edge of a side wall and 100% of the lower panel resides below the upper edge of a side wall when the transformable divider is in the extended position.

The non-hinged side of each panel, forming the top edge (70) and bottom edge (80) of the transformable divider as a whole, may be connected to a wall of the pack so as to be non-movable, or alternatively to a top or bottom edge of an adjacent transformational panel when transformational panels exist in a stacked series. This is described further below and in FIGS. 4, 5, 6 and 7. The left side edges of the transformable divider (90) and right-side edge of the transformable divider (100) may be loosely connected to the side walls of the pack so as to create a complete separational barrier between the storage compartments in front of and behind the transformable divider; yet facilitating movement of the transformable divider from one position to another. See (130) in FIG. 2. In this particular embodiment, the attachment is permanent (stitched) making the transformable divider non-removable. In alternative embodiments such a permanent attachment could be obtained via riveting, glue, or other means of permanent attachment. In yet another embodiment of the present invention, the transformational panel-associated container may be non-permanent and capable of being completely removed (i.e., may be a removable and re-insertable "core"), which, for example may be attached to the pack via zipper, snaps, magnets, Velcro/hook-and-loop attachments, and other similar attachment mechanisms and/or which may be contained through slotting of part of the core into slots, binding with wires or straps, or the like. Whether permanent or temporary any attachment typically is made in such a manner to allow freedom of movement when desired to transform the transformable divider from one configuration to an alternative configuration.

The width (110) of the transformable divider in the illustrated embodiment (see, e.g., FIG. 1) is slightly greater than the width of the storage compartment in which it is contained, such that a tight fit is created when the transformable divider is in the extended position. In this configuration, the panels of the transformable divider may not substantially shift horizontally side to side.

Figure 2:
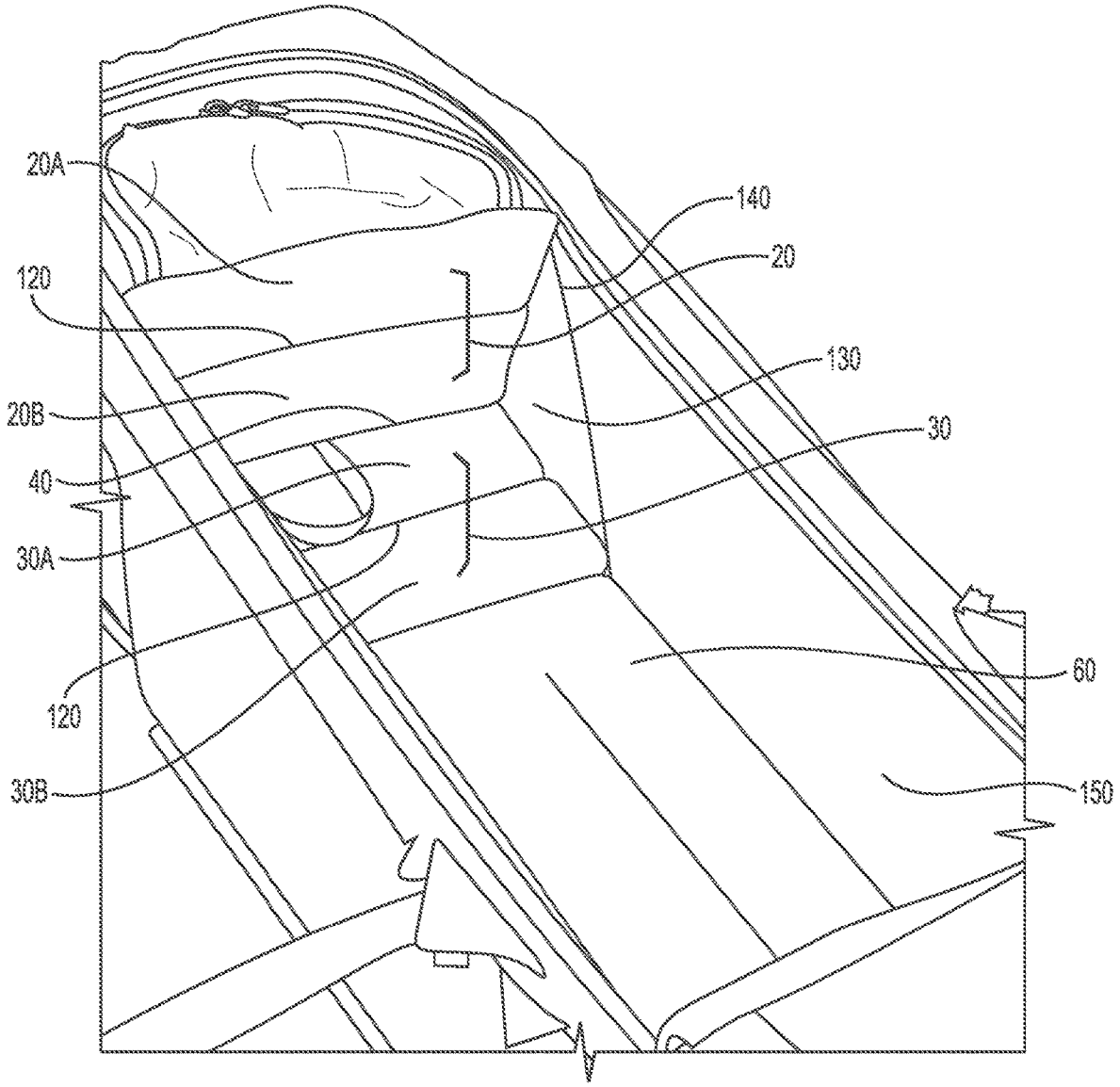
FIG. 2 is an alternative view of a transformable divider in a first position within an embodiment with additional detail regarding its functional features.
Figure 3:
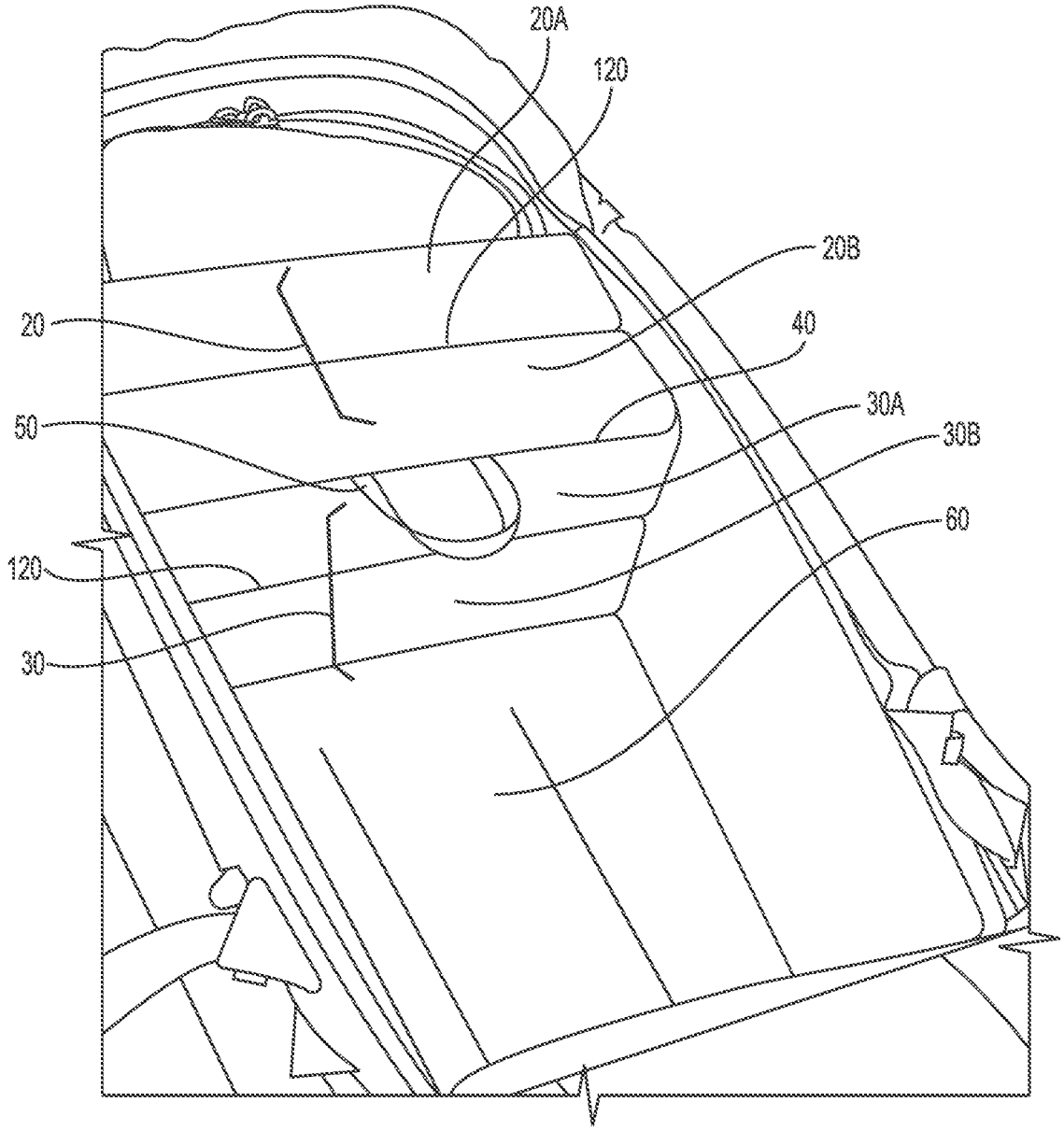
FIG. 3 is a view of a transformable divider in a second position within an embodiment.

The central hinge (40) of each transformable divider in the illustrative embodiment shown in FIGS. 1-3 is capable of providing (i.e., is adapted/configured to provide) reorientation of one panel to the other and is capable of swinging at least 270 degrees at any one time in both directions, typically repeatable without significant loss of function over a number of uses, period of time, and various storage conditions. For example, examining the panels from a side view such that only the edges of the panel are visible on an x-y axis, the panels may be in one configuration such that the upper panel is in a horizontal position following the negative x (−x) axis of the x-y graph/axis and the second, lower panel may be in a position perpendicular to (i.e. at a right angle) to the upper panel and following the negative y (−y) axis, with the central hinge point being at the point (0,0) on the graph. The central hinge may provide broad enough movement such that the two panels may be reoriented to one another by moving the upper panel from its horizontal position along the −x axis to a vertical position as if in alignment with the positive y (+y) axis; simultaneously, the lower panel is moved from the −y axis to the positive x (+x).

To further aid in the flexibility and ease of transition of the transformable divider from one position to another, each upper (20) and lower (30) panel of the transformable divider in the illustrative embodiment is further divided into 2 sub panels; 20A and 20B and 30A and 30B respectively, as exemplified in FIG. 2. Each subpanel is separated from its pair by a subpanel hinge (120), flexible in both directions but which provides less freedom of movement than the central hinge between the two full upper (20) and lower (30) panels. Also exemplified in FIG. 2, is the connection mechanism (130) (previously referred to) that resides both on the left and right sides of the transformational panel. This connection mechanism, exemplified in the preferred embodiment as loose lining cloth, is affixed to the sides of the upper and lower panels of the transformable section along their edges as well as optionally to the angled top edge (140) of the pack side panel (150). The side panel (150) design, and its specific characteristics are further described below.

The extended configuration of the transformable divider is exemplified in FIG. 3. In this configuration, the upper panel (20) and lower panel (30), again are oriented at right angles to each other, however in an opposite orientation than when the transformational panel is in the recessed position.

Transformable dividers may be positioned horizontally across a pack such that the side walls of the section are oriented toward the side walls of the pack. In this orientation transformable dividers may exist alone or in vertical or stacked series, with a transformable divider directly above or below it, with an upper and or lower panel of a transformable divider connected to an upper or lower panel of an adjacent transformable divider, connected by a flexible hinge between the two. In such a configuration, the lower panel of the first transformable divider becomes the upper panel of the second transformable divider. In this embodiment, when both transformable dividers are configured in extended positions, one, new larger transformable divider is essentially created, with a new "lower panel", created by the combination of the lower panel of the first and the upper panel of the second transformable dividers in series, that is larger than its upper panel, created by the upper panel of the upper first transformable divider. In this embodiment, additional flexibility and space reallocation is possible as larger transformable dividers are possible with varying combinations of transformable divider configurations.

This embodiment, illustrated in FIGS. 4 through 7, illustrates that multi-transformable divider design are not limited to a particular layout. Specifically, the embodiment shown in FIGS. 4-7, comprises a storage compartment (60) of a container which comprises three transformable dividers, (160), (170), and (180).

Figure 4:
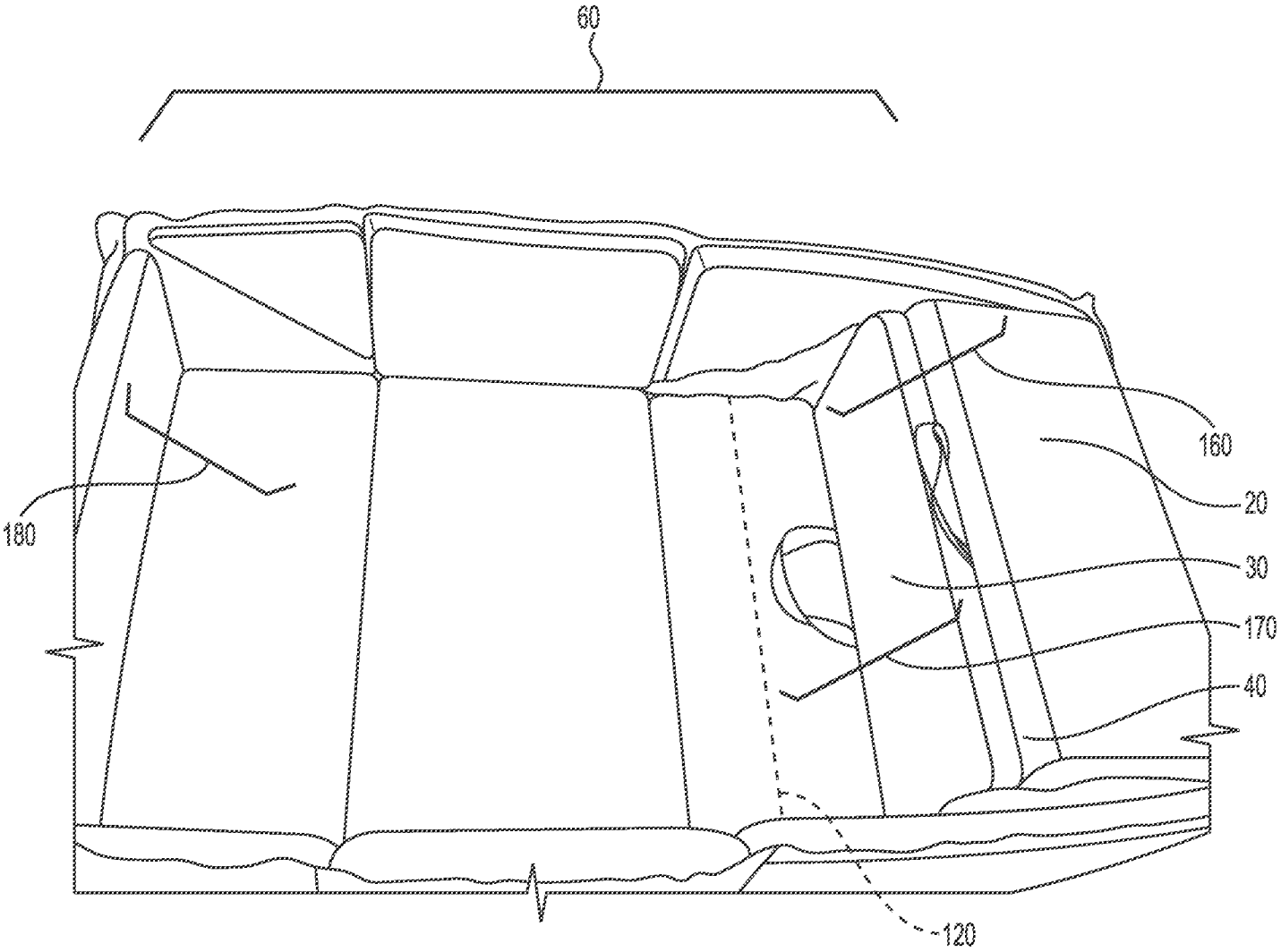
FIG. 4 is a view of one configuration of an embodiment of a system comprising multiple transformable dividers.
Figure 5:
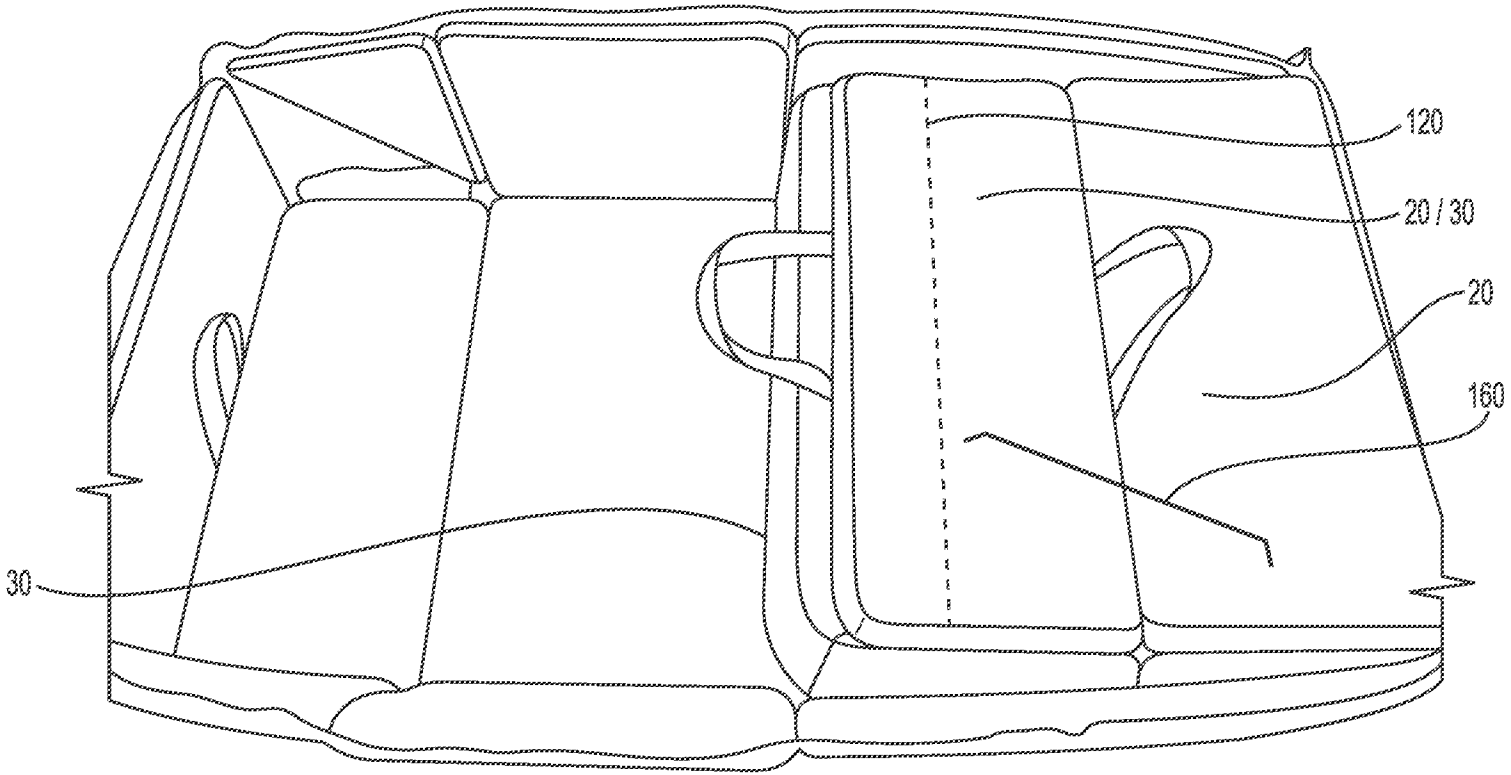
FIG. 5 is a view of a second configuration of an embodiment of a system comprising multiple transformable dividers.
Figure 6:
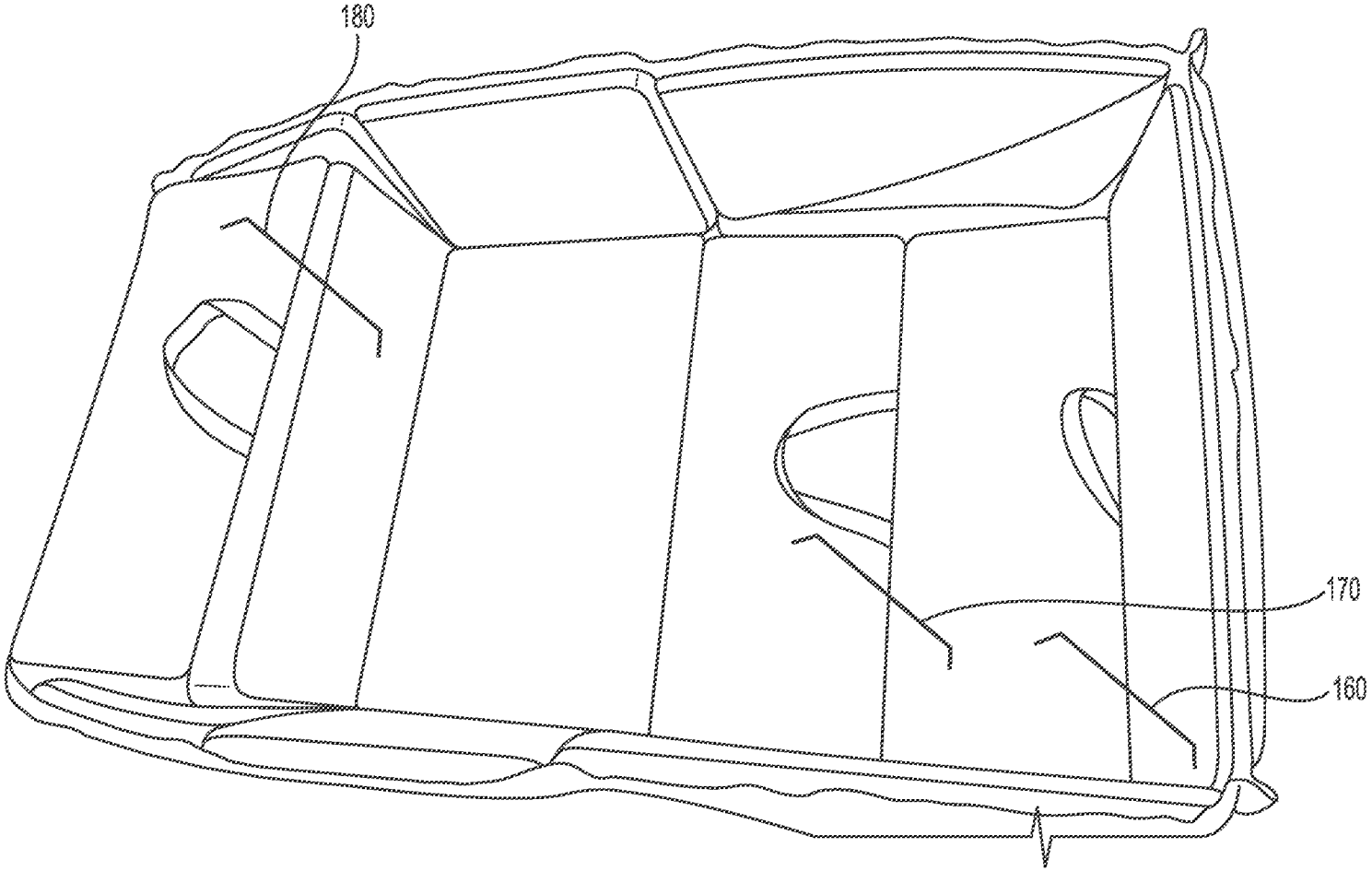
FIG. 6 is a view of a third configuration of an embodiment of a system comprising multiple transformable dividers.
Figure 7:
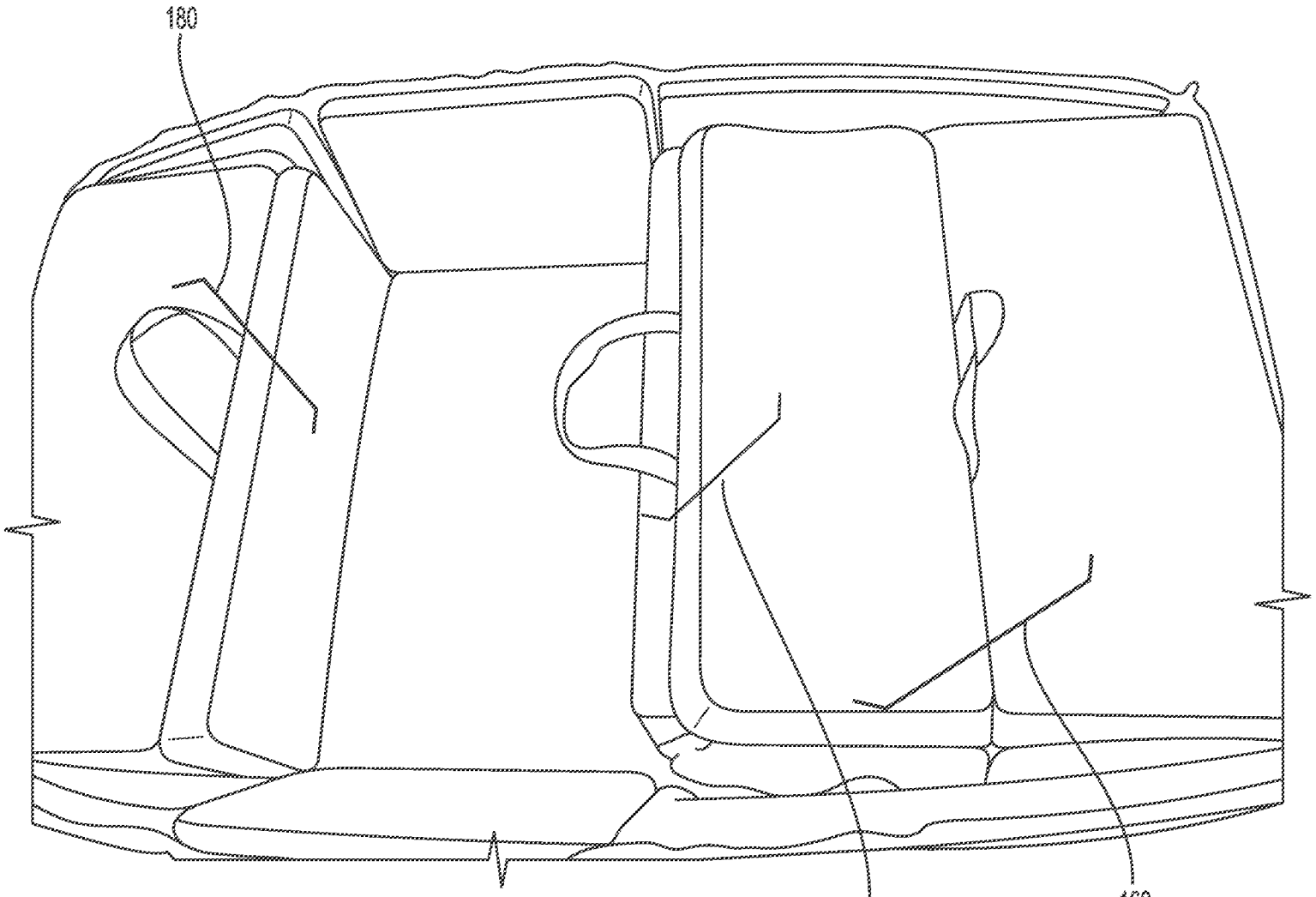
FIG. 7 is a view of a fourth configuration of an embodiment of a system comprising multiple transformable dividers.

In FIG. 4, The first transformable divider of the series (160) may be configured in the extended position while the other transformable dividers (170) and (180) remain in the recessed position. In FIG. 5, the multiple transformable divider design is again exemplified, this time with both transformable divider (160) and (170) simultaneously positioned in the extended configuration. When two transformable dividers lie in series with one another as in this example, the lower panel (30) of one transformable divider, here transformable divider (160), also functions as the upper panel (20) of the second adjacent transformable divider (170). In this example, the third transformable divider (180) remains in the recessed position. In FIG. 6, the multi-transformable divider design is again shown, this time with transformable dividers (160) and (170) both in the recessed configuration while the third transformable divider (180) is in the extended position. Finally, FIG. 7 shows the multi-transformable divider design with all three transformable dividers (160, 170, and 180) in the extended position.

Figure 8:
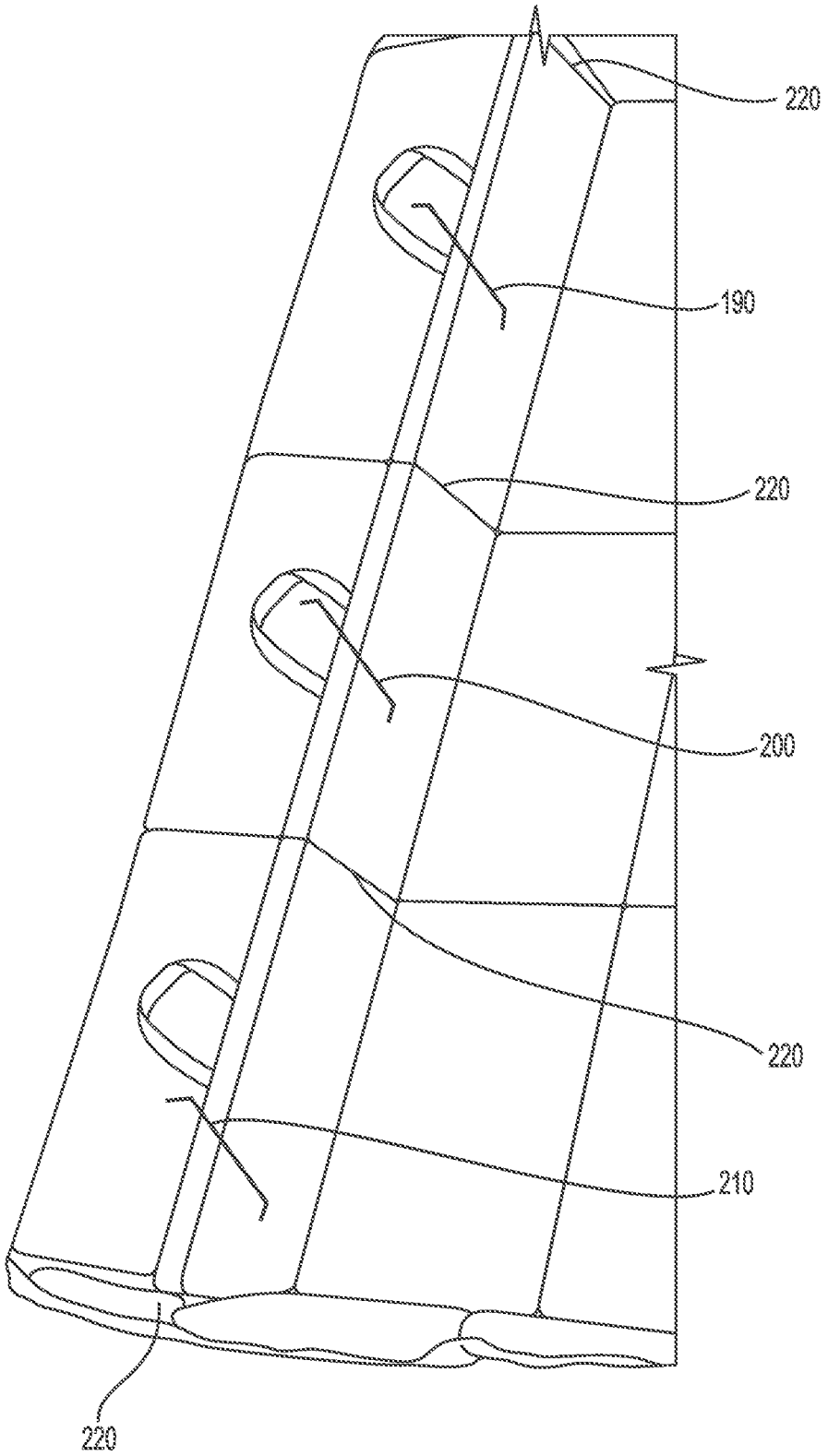
FIG. 8 is a view of a fifth configuration of an embodiment of a system comprising multiple transformable dividers.

Alternatively, the transformable dividers may be oriented vertically within a pack, such that the side walls of the section oriented toward the top and bottom of the pack. In this orientation, transformable dividers may also exist alone or next to/contiguous with a transformable divider directly above or below it; however instead of the upper and lower panels of the transformable divider being in contact with the upper or lower panel of the transformable divider above or below it as previously described, in this orientation the sides of the transformable dividers may be adjacent to the sides of a transformable divider above or below it. In this orientation, the side edges of the two panels making up each transformable divider may be loosely connected to an enclosing connection device (220), elsewhere herein referred to as a sidecover, in this embodiment loose lining material), such that the two adjacent transformable dividers may both be in the extended position, recessed position, or one in one configuration and the other in the opposite configuration, yet the compartment defined by the transformational panels from which the transformational panels are being viewed, and the separate and distinct compartment defined by the back side of the transformational panels, are each fully enclosed. The enclosing connection device is attached to the edge of the upper and lower panels of the transformable divider with sufficient slack so as to allow repositioning of the transformational panel from one configuration to another. FIG. 8 illustrates one embodiment of such a design. As shown, transformable dividers (190), (200), and (210) are aligned vertically to one another with their side edges facing one another. Each side of each transformable divider is covered by an enclosing connection device (220).

A transformable divider may be repositioned to a second position from a first position by applying force to the transformable divider, such force application mechanism exemplified as previously mentioned in FIG. 1 by the ability to pull on a handle (50). The force required to move the two panels comprising the transformable divider described above is an element of the design. This force may be a pull force in a direction away from the pack, in order to configure the transformable divider in an extended position. This force may be a push force in a direction toward the pack, in order to configure the transformable divider in a recessed position. The maximum force required to push or pull the transformable divider from one orientation to another must be such that it may be quickly and easily accomplished by the user. Such a required force is approximately less than 350 N. An element of the invention is the interaction of the transformable divider with the side walls of the pack. As described previously, the width of the transformable divider spans the width of the storage section and is slightly wider, creating a tight horizontal fit of the transformable divider along the sides of the transformable divider inside the storage compartment.

Figure 9:
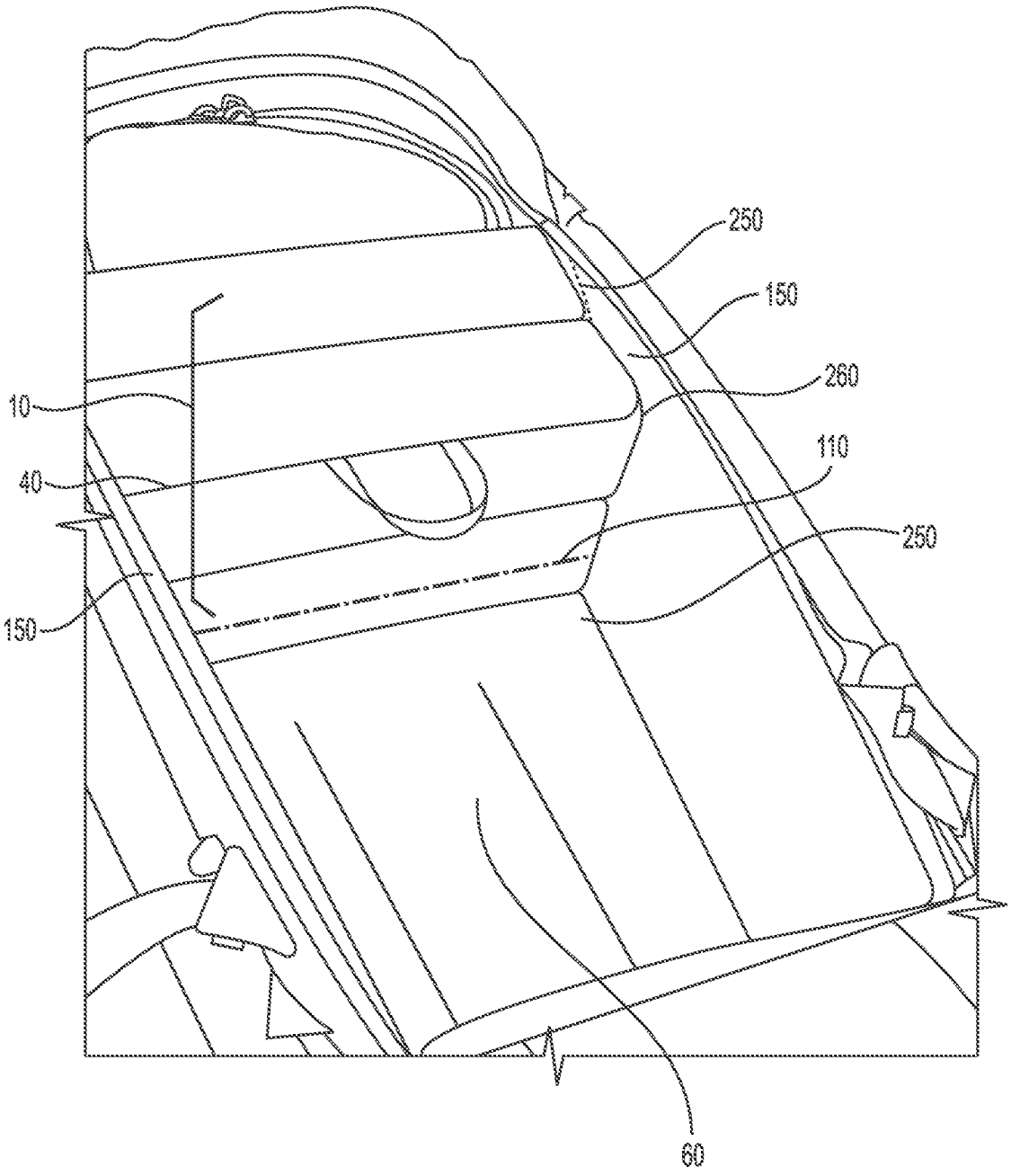
FIG. 9 is a view of a transformable divider within an embodiment with the transformable divider in a second position and its relationship to the outside walls of the larger system in which the transformable divider resides.

FIG. 9 further illustrates this fit. As shown therein, the width of the transformable divider (110) is such that it is slightly wider than the width of the storage compartment (60) in which it resides, such that the transformable divider is squeezed between the two side walls (150) of the storage section. This creates no measurable gap between, i.e. the central hinge (40) of the transformable section and the side walls (150).

Figure 10B:
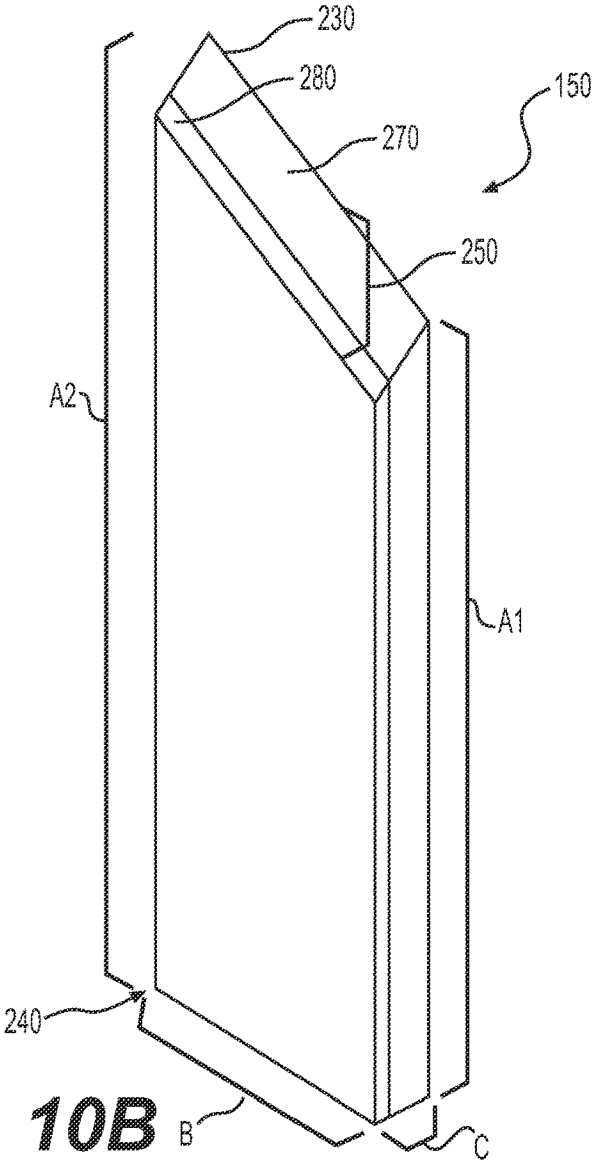
FIG. 10B provides an alternative view of the side wall panel of FIG. 10A.
Figure 10A:
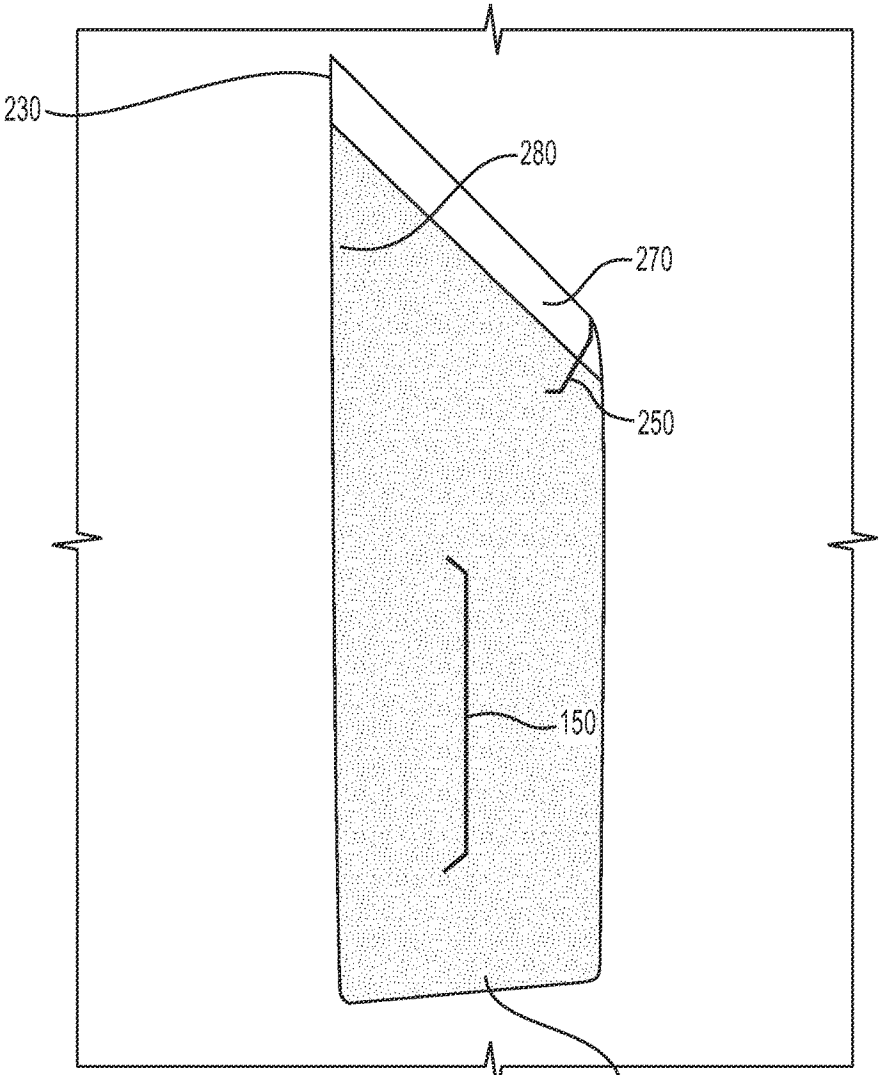
FIG. 10A is a view of the core material of a side wall panel, its shape, and the reduced friction area incorporated therein.

The side walls of the pack are shown in FIG. 10A removed from the pack itself. These side walls, having an upper end (230) and a lower end (240), further described below, have an area of reduced thickness (250) on the upper end of the panel, the end of the panel adjacent to and in contact with the transformable divider. In accordance with certain embodiments, such area of reduced thickness could also be present on more than one end of a side wall.

When the transformable divider is in the recessed position and the user begins to apply a pull force to change the transformable divider from the recessed position into an extended position, because the width of the side wall to which the transformable divider is making contact, is less where the side wall is of a lower thickness, the friction created is less when first starting to pull and more when the transformable divider is in the fully extended position. This characteristic of certain embodiments is illustrated in FIG. 9, where the area of reduced thickness (250) is slightly visible. The tightness of fit in the partially recessed position of the transformable divider between the side walls, as the transformable divider is beginning to be pulled from the recessed to the extended position, is less than when in the fully extended position such that the initial force required to begin to transition the transformational panel into the extended position is reduced, facilitating the movement and reducing the ability of the transformable divider to get stuck against the side wall of the pack. In the fully extended position, the tightness of fit is at its highest as, as previously described, the hinged section of the transformable divider overlaps with the thickest part of the side panel (area where there is no reduction in thickness) (260). In this manner, horizontal movement of the transformable divider toward either side wall of the pack is reduced by a significant amount, and such tightness of fit assists in maintaining the structural integrity of the formed storage compartment.

To further assist in the both the ability of the panels of the transformable divider and the creation of a tight fit between the panels of the transformable divider and the side walls of the pack, dual-layered panel and outside wall panel cores can be utilized. Additionally illustrated in FIG. 10A, the first layer (270) of the core provides structural integrity. This layer is comprised of a durable and sufficiently dense and strong material for maintaining cargo without readily undergoing deformation, such as hard EVA foam. This first layer is relatively hard and stiff compared to a second layer. The second layer (280), with a thickness less than that of the first layer, is more malleable and provides a "cushion" on the second layer. The material exemplified in the example figures is a CLPE sponge. In the side walls of the pack, the softer, more cushioning CLPE sponge layer faces inward to the pack. In the panels comprising the transformable divider, the CLPE sponge layer faces inward toward the inner core of the pack. In this way, when the transformable divider is moved from the fully recessed configuration to the fully extended configuration, it is these two CLPE sponge layers that interface directly. Because they both are able to absorb the pressure applied by the other, the panels are able to more freely slide past one another yet create a tight contact with one another and therefore help maintain structural integrity. FIG. 10B illustrates a different perspective of the side panel (150) of FIG. 10A, wherein the side panel (150) of FIG. 10A is shown slightly rotated, to provide a three-dimensional (3D) perspective of the panel. FIG. 10B illustrates the same elements presented in FIG. 10A. For the sake of clarity, FIG. 10B further explicitly provides labeling of dimensions. Specifically, element "A", represented by A1 and A2, is the dimension of length of the side panel (150), wherein A1 is shorter than A2; "B" is the dimension of width, wherein the panel has a first width at the bottom of the panel (240) and a reduced width at the top of the panel (230); and "C" is the dimension of thickness, wherein the panel has an area of reduced thickness (250) toward the top of the panel (230). For sake of clarity, the two material layers (270) and (280), as described in reference to FIG. 10A, are shown again in FIG. 10B.

The force required to move the transformable divider from a recessed to an extended position or vice versa is minimized by providing flexibility of the upper and lower panels comprising the transformable divider. This is accomplished by creating a more flexible, or weaker, horizontal line across each of the panels; a purpose of the subpanel hinge (120). This may be accomplished using a stitched seam or other type of flexible or mechanical hinge and is exemplified in previous figures, for example FIG. 2. This weaker point must be such that it provides flexibility in movement of the panel from an inward to an outward (recessed to an extended position) but does not negatively impact the resistance of the panel to deformation when stored items are placed inside of the storage compartment which it defines.

One can see that the transformable divider in a selected configuration, for example the extended position, may create a "pocket" or an L-shaped shelf storage compartment in the storage compartment on the opposite side of the transformable divider. In this configuration, stored objects may rest on a single panel of the transformable divider. In order to maintain structural integrity when load bearing, the material utilized to form the panels must have a minimum level of load strength and that strength is dependent on the tautness of the panels and their attachment to one another and to the outside frame walls of the pack. In this particular embodiment, each of the upper (20) and lower (30) panels of the transformable divider are 9.625 in (24.45 cm) wide and 4 in (10.2 cm) deep and when connected by a central hinge to form the transformable section, each panel is capable of bearing a minimum weight of at least about 250 grams without deformation of more than 5% under 20 or more hours of use, i.e. bearing a load weight of 0.2 kg (approximately 0.44 lbs), 0.5 kg (approximately 1.1 lbs), 1 kg (approximately 2.2 lbs), 5 kg (approximately 11 lbs) or more.

Figure 11:
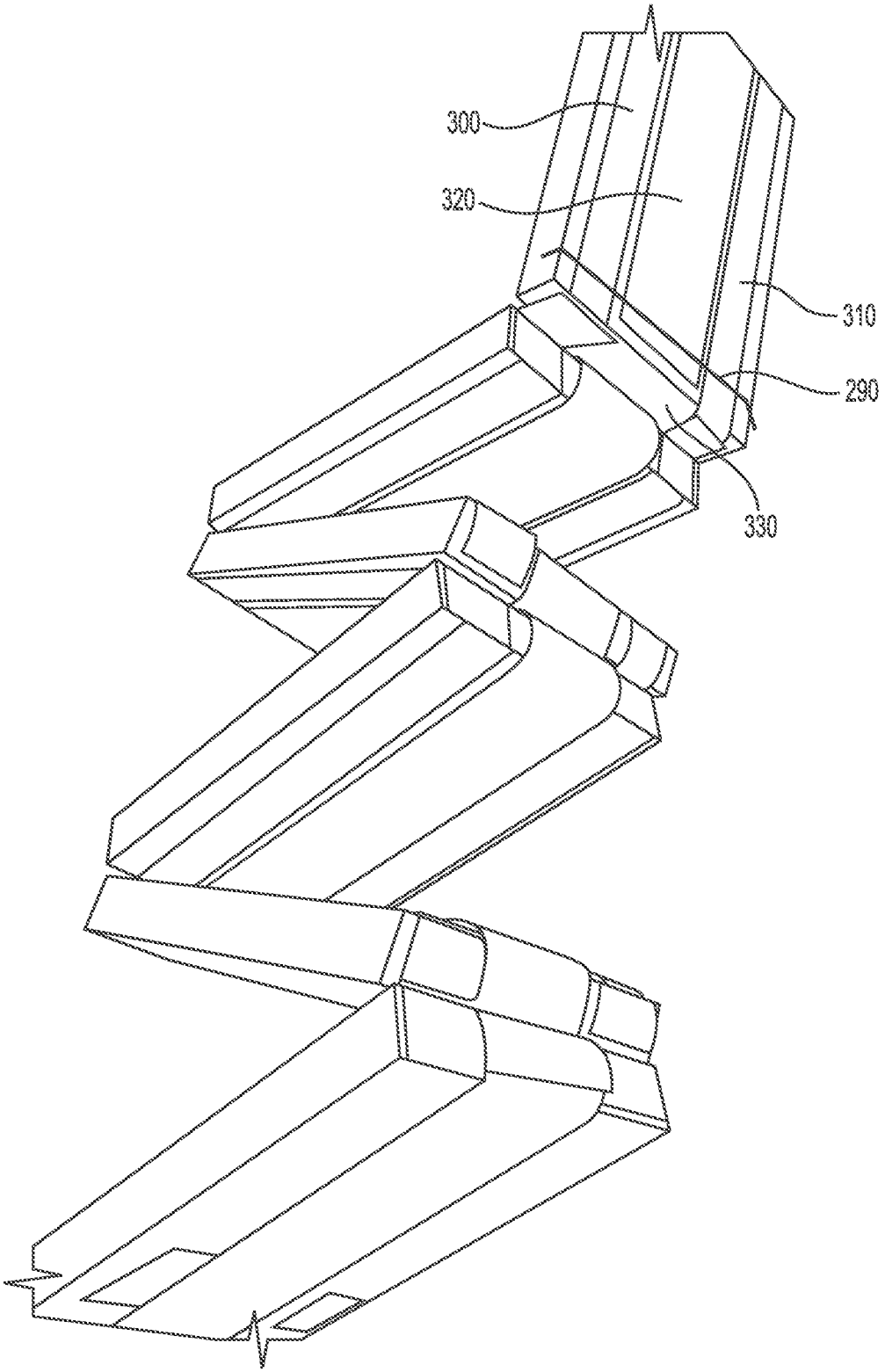
FIG. 11 is a view of the basic design of the stackable-linear-rotational divider (SLR), which also is sometimes referred to herein as a multi-point adjustable divider.

An element of the present invention is the inclusion of one or more independent, removable and reconfigurable dividers which may be used to secure and separate components of differing sizes and shapes to be stored and protected within a storage section or larger container. Such a feature is exemplified in FIG. 11. In this embodiment, such a feature is designed like that of a Jacob's Ladder toy, where a plurality of panels (290) are interconnected through a plurality of ribbons (300), (310), (320) or ribbon-like strips, woven in and out along the series of panels. Each panel (290) may be positioned in relation to an adjacent panel along its edge (edge of panel in the same location as the hinge point (330)) or along its face as if they are stacked together. At the hinge point, the panels are able to move approximately 360 degrees about the hinge. The panels are all of equal size, with the horizontal edges of each panel in alignment with any panel above and below. A minimum of three interwoven ribbons or ribbon-like strips are used to interconnect each panel to the panel adjacent to it in such a manner so as to create a double-hinge. Two such ribbons (300) and 310) are fixed at the end of one of the adjacent blocks, interwoven in a first direction while a third ribbon (320) is attached to the opposite end of the same adjacent block and is interwoven in a second direction. The ribbons are configured such that each ribbon is free to fall across the face of the block to which it is attached and is then attached to the adjacent block at the hinge point (330) of the blocks. In this way, a double hinge is created, with one ribbon in the one direction and the other with the pair ribbons in the opposite direction. This interwoven, double-hinged series of panels in what has come to be known as the Jacob's Ladder design has been previously described. The series of three ribbons in this design may be of the same width or of varying widths but must be of sufficient total width when combined so as to provide functional support to the series of panels, as they hold the panels together in an aligned series as each panel is allowed to flip end-over end or tumble down the chain of panels in series.

As described, multiple double-hinged panels (290) make up a single reconfigurable divider. The ribbons creating the double hinge must allow the position of each individual panel comprising the larger divider may be freely moved and reoriented in relation to others. Such connecting ribbon must be taught enough to prevent unwanted movement of panels, holding them in alignment with one another. As one manipulates the position of each panel, allowing panels to fall, tumble, or flip, across the faces of adjacent panels, one can create a variety of shapes and configurations, any of which may be specifically chosen and customized to fit the item or items requiring storage. Such freedom of orientation between the panels allows for the positioning of a panel or panels perpendicular to others at any point along the series. During such movement, a panel being repositioned remains connected and in constant contact with one or more other panels comprising the divider system. That is, panels may be arranged in any configuration from each panel being linearly aligned with the next in order to form a long, single direction, linear series of panels each interfacing/touching the panel above and below it or alternatively, the freedom of movement of each panel may allow for a single panel, again, to roll or tumble down the chain of other interconnected panels so as to facilitate creation of panels perpendicular to others at any point along the linear series. In addition, the panels are capable of stacking one on top of another forming a compact, closed configuration. Such a configuration may be useful for storing the divider until use is required. For example, in a divider comprising a series of 10 panels, a sequence may be designed where odd numbered (every other panel starting with the first in a series) panels are oriented in a vertical position and alternating even numbered panels are oriented in a horizontal position, perpendicular to the odd numbered, vertically oriented panels above and below it. Alternatively, every third or every fourth panel may be oriented horizontally in relation to vertically oriented panels above and below it. In yet another configuration, there may be no pattern between vertically oriented and horizontally oriented panels in the series. Further still, any panel along the series may be positioned at an angle other than 90 degrees relative to any panel above or below it so as to create less symmetrical or linear storage compartment shapes. In this way, the divider may be configured so as to create divided sections of varying sizes and shapes to accommodate stored gear of different shapes and sizes.

Figure 12:
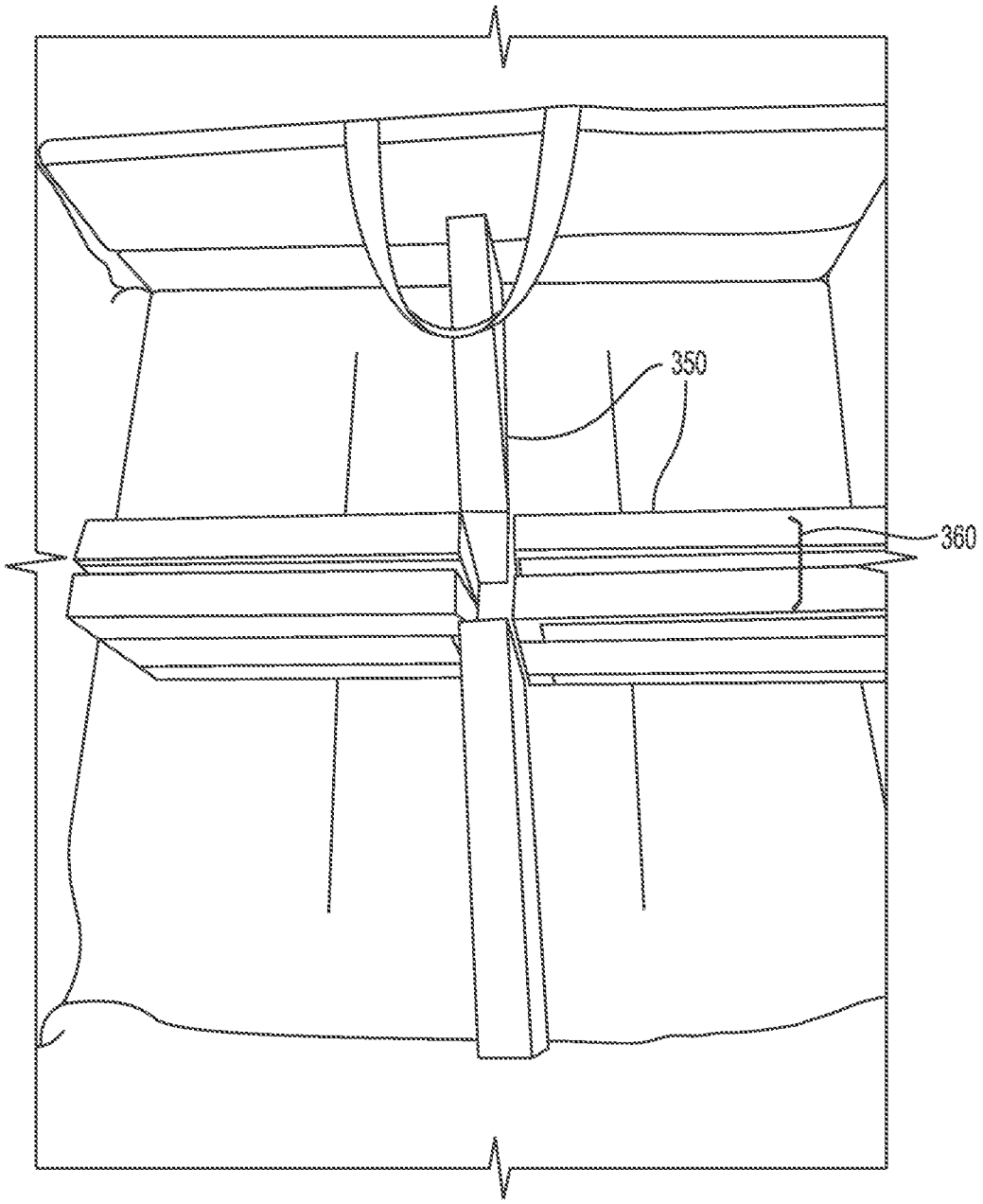
FIG. 12 is a view of one possible configuration of the stackable-linear-rotational divider (SLR), specifically demonstrating the ability of the SLR to form right angles and stacking.
Figure 13:
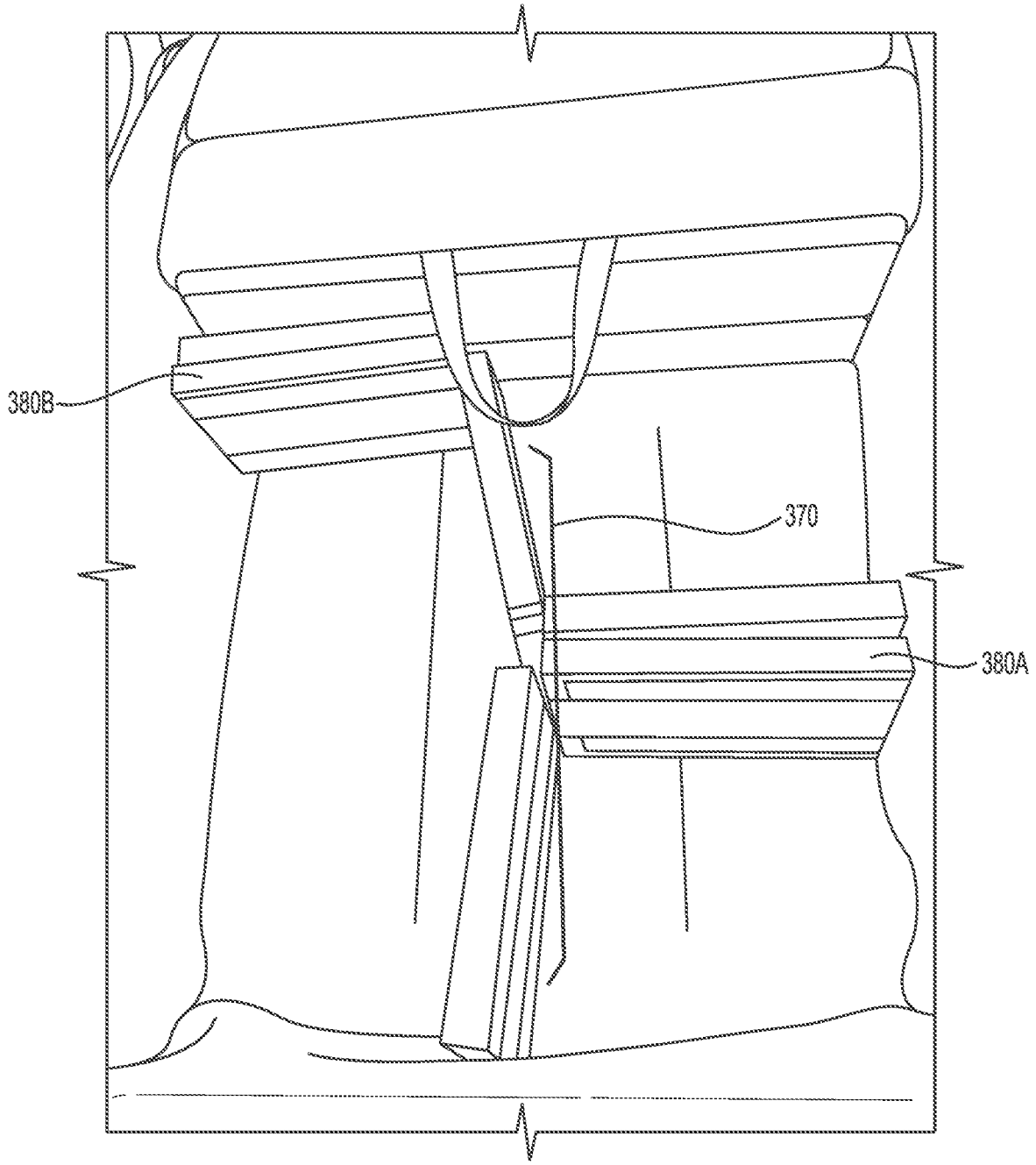
FIG. 13 is a view of a second possible configuration of the stackable-linear-rotational divider (SLR) specifically demonstrating the ability of the SLR to form right angles in varying locations.
Figure 14:
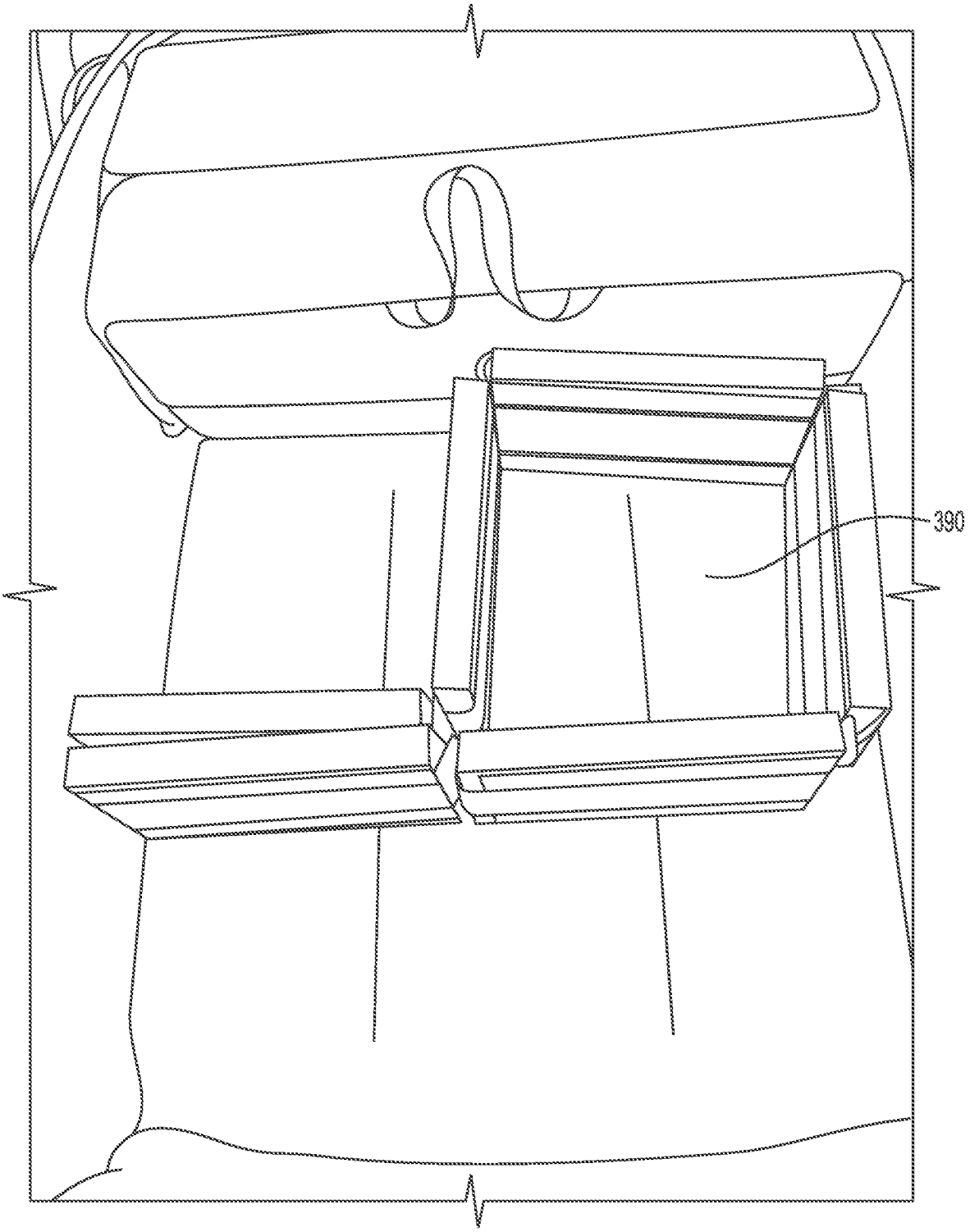
FIG. 14 is a view of a third possible configuration of the stackable-linear-rotational divider (SLR) specifically demonstrating the ability of the SLR to create a fully encompassed storage section.
Figure 15:
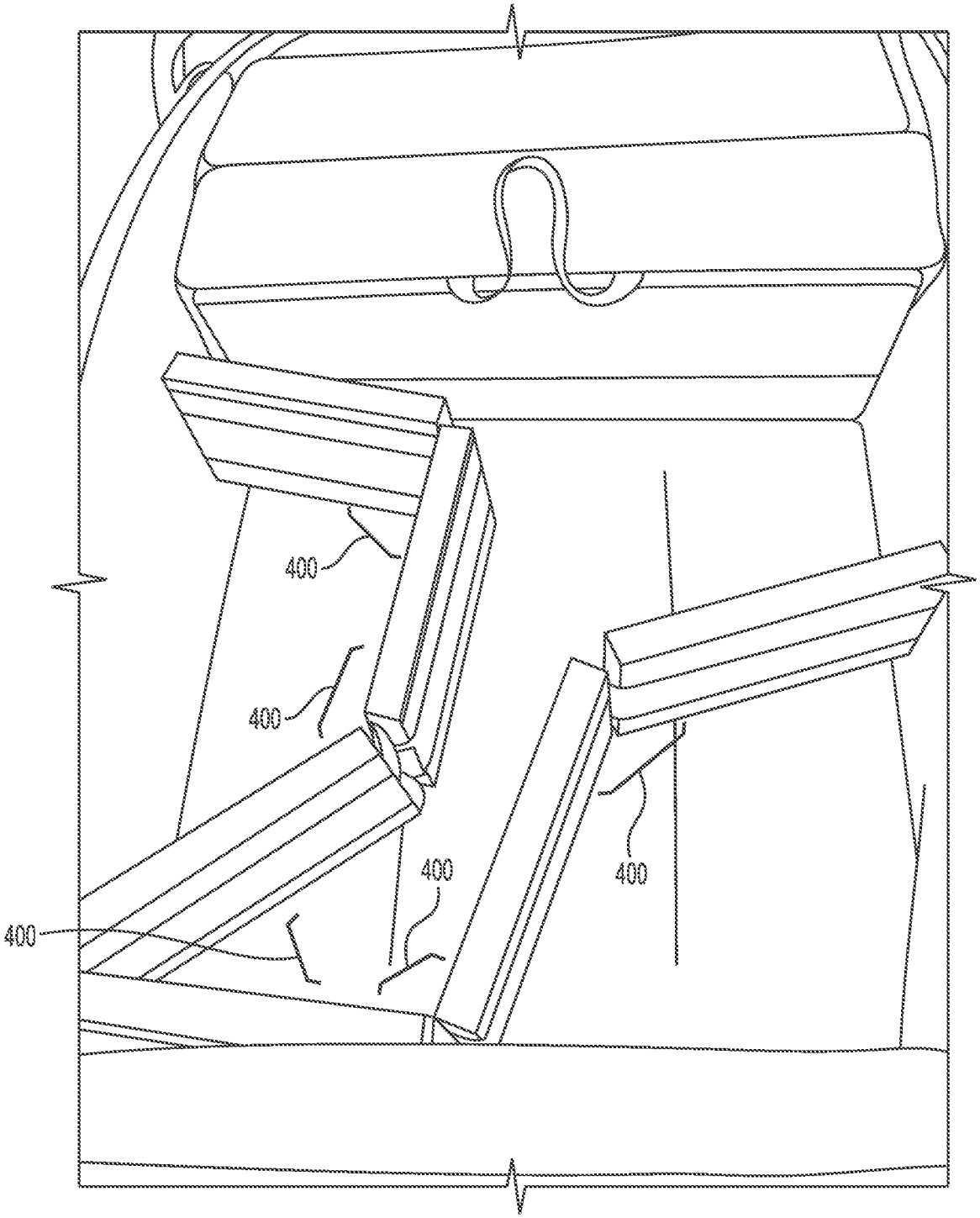
FIG. 15 is a view of a fourth possible configuration of the stackable-linear-rotational divider (SLR) specifically demonstrating the ability of the SLR to form non-right angles.

FIGS. 12 through 16 illustrate the flexibility and customization ability of such a divider system. In FIG. 12, a right angle (350) is created by orienting panels perpendicular to each other. Panels may be stacked (360) to create wider dividers. Configurations such as a cross as illustrated in FIG. 12 creating 4 or more similarly sized storage compartments may be created. FIG. 13 illustrates a possible configuration of the divider such that a panel perpendicular to a series of panels (370) is created in one direction (380A) while a second panel perpendicular to a series of panels is created in the opposite direction (380B) and at a different point along the series of panels. In FIG. 14, the panels of the divider are positioned in such a way so as to create an enclosed storage section (390), bordered on all sides by individual panels of the larger divider. FIG. 15 illustrates that the panels of the divider system do not need to be oriented perpendicular to one another; that is, angles other than 90 degrees between panels may be created. In this way, odd shaped items, such as longer poles or objects with bends or angles in them themselves may be separately and/or securely stored in the associated container compartment.

Figure 16:
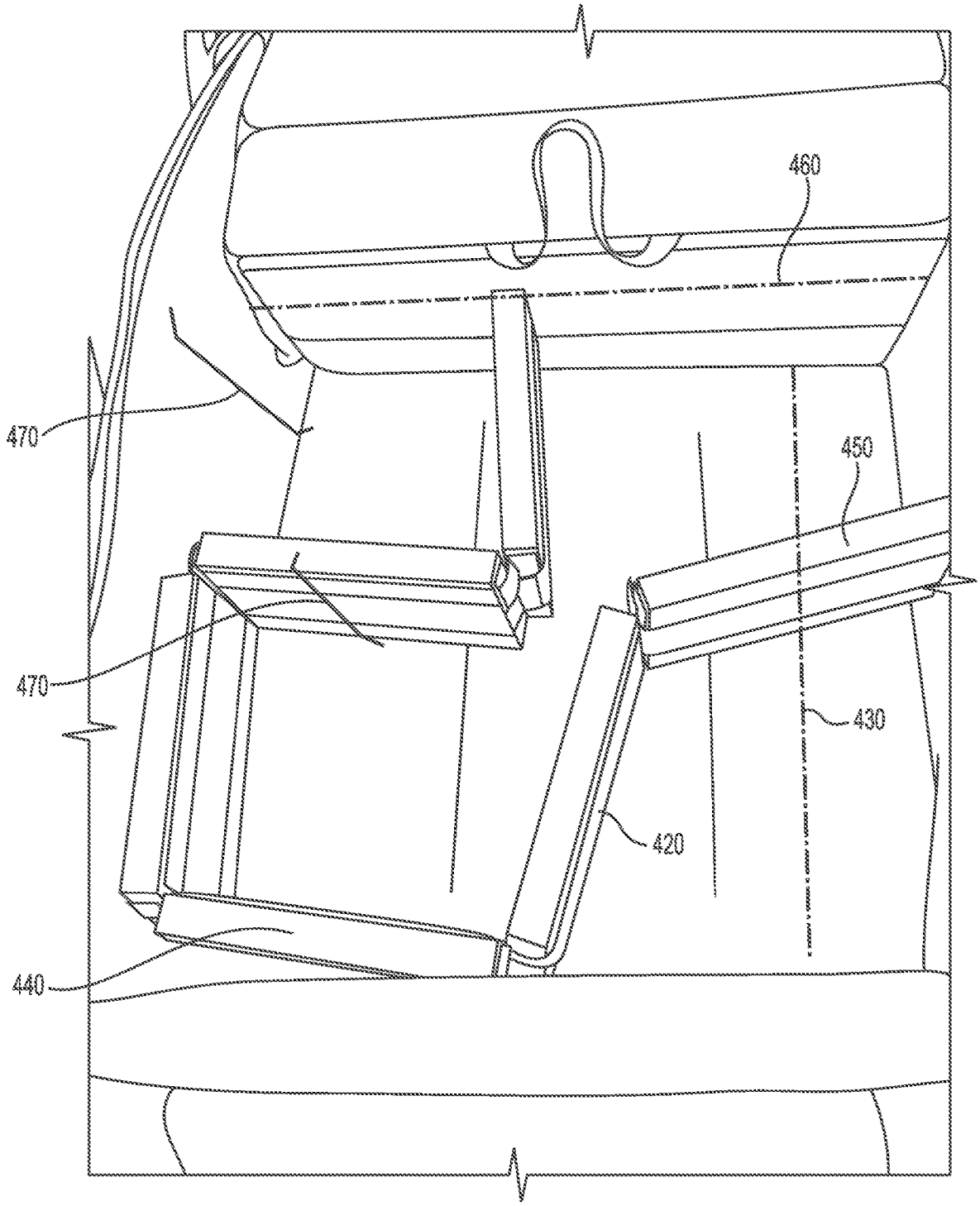
FIG. 16 is a view of the stackable-linear-rotational divider (SLR) demonstrating the relationship of the number and sizes of panels to dimensions of the space in which it resides.

One facet of the dividing system is the manner in which it may securely fit within a storage compartment of a pack. The number of panels in the divider system, and the size of each panel, must be carefully designed in conjunction with the size of the compartment into which it may be placed. FIG. 16 illustrates this point. In FIG. 16, the width (460) and height (430) of the compartment into which this divider may be placed is synchronized with the length of 2 divider panels (i.e. panels (410) and (420), or panels (440) and (450). This facilitates the construction of a divider which may not shift or move vertically or horizontally within the storage section into which it is placed. In addition, the width of each panel and the depth of the storage section (470) (or alternative described as the height of a reconfigurable divider panel when lying on its side as used in the invention and the depth of the storage section) may be substantially equal. Alternatively, the width of the divider panel (its height when lying on its side) may leave a gap between its height and the depth of the storage container that may in one embodiment of no more than 50% of its height. This ensures that when the storage container is closed, stored objects may not fall over the walls or panels of the divider system, being securely held in place by the panels of the divider system and the floor and roof of the storage section.

Figure 17:
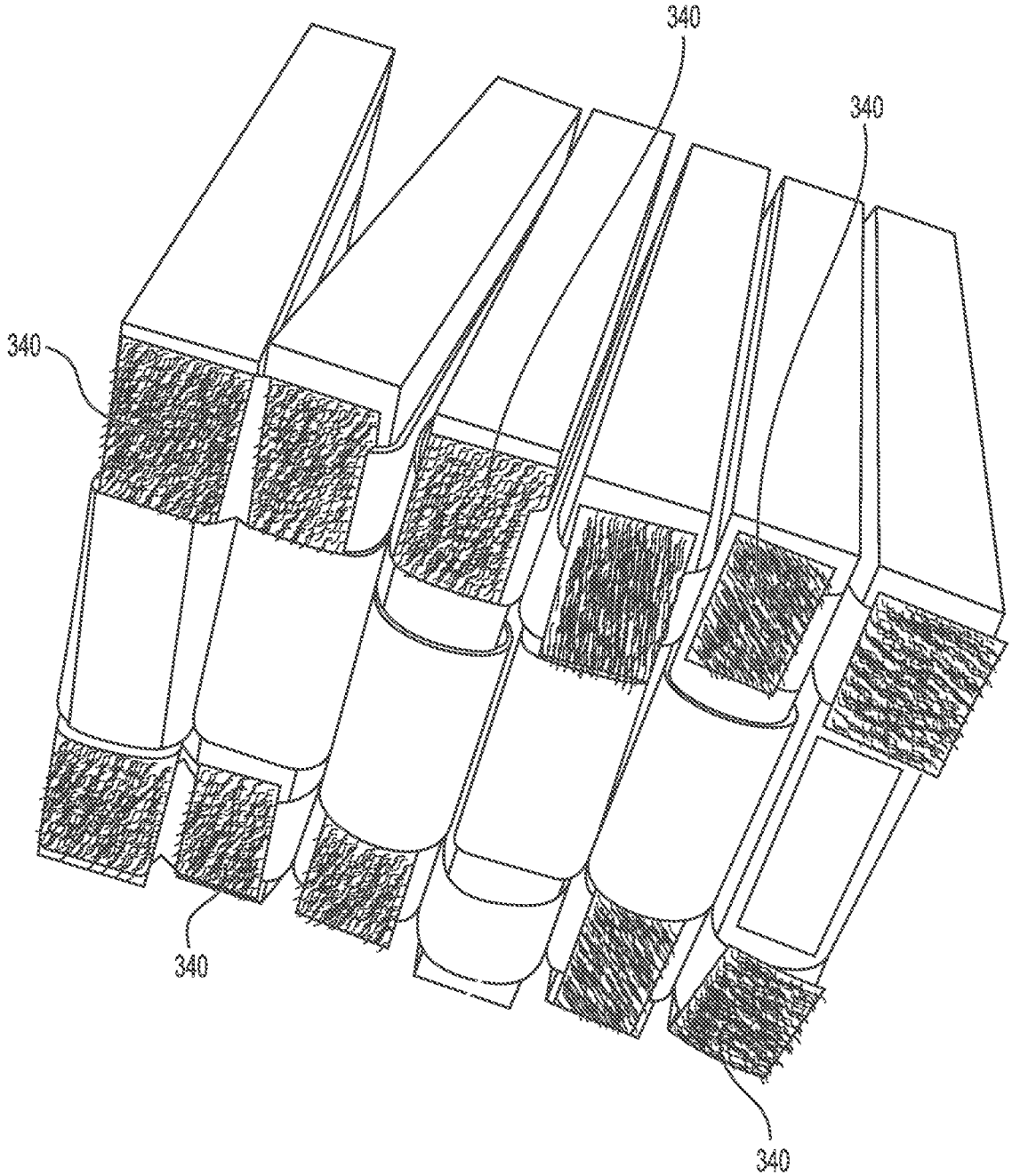
FIG. 17 is a view of the stackable-linear-rotational divider (SLR) and one embodiment of an incorporated attachment mechanism as well as a fifth possible configuration of the SLR.

Another element of this reconfigurable divider system which helps to ensure that the system does not move is the novel use of attachment elements. In FIG. 17, one can see that along each edge of each panel which may "roll" when being reconfigured across the edge of an adjacent panel, and along the top edge and bottom edges of the first and last panels of a series, a hook attachment (340) (i.e. the hook portion of a Velcro® system) is affixed. As the panels are reconfigured and the ends of one panel interface with the ends of an adjacent panels, the hook attachment of each end may interface however because they are both hook systems, they will not stick together. However, when an edge of a panel interfaces with an outside wall of the storage compartment, when lined with any material in which a loop system comprises its material design, the hook system of the panels will stick and attach to the loop system of the liner. In this way, the reconfigurable divider system may be held in place. Such hook elements could optionally be a component of the longer side edges of the reconfigurable divider system panels, that is, those edges which do not interface with other panels, such that the longer side edges of the reconfigurable divider system panels may attach securely to a wall of the storage compartment comprising a loop system element.

The panels comprising the divider system must be resistant to shape deformation in order to securely hold the items being stored safely within the larger container when being transported, jostled, dropped or otherwise challenged with movement. The dividing system must maintain protective separation between stored items by remaining securely in place and maintaining physical distance between stored objects such that they cannot come into physical contact with one another. The panels of the dividing system should be made of material with structural integrity yet provide enough shock absorbance to protect items stored within the dividing system.

To provide further customization of storage options, one embodiment of the present invention includes a removable core or insert. Such a removable core or insert may be capable of providing removable and modifiable storage capacity and may be referred to herein as an insertable core, removable core, insert, storage insert, storage core, or similar terminology. This insert is not permanently attached to an outer storage container in any way and may function either as an insert within a larger container, as a completely separate carrying device, or both. Exemplary embodiments of such an insert, or removable core, are shown in FIG. 18.

Figure 18:
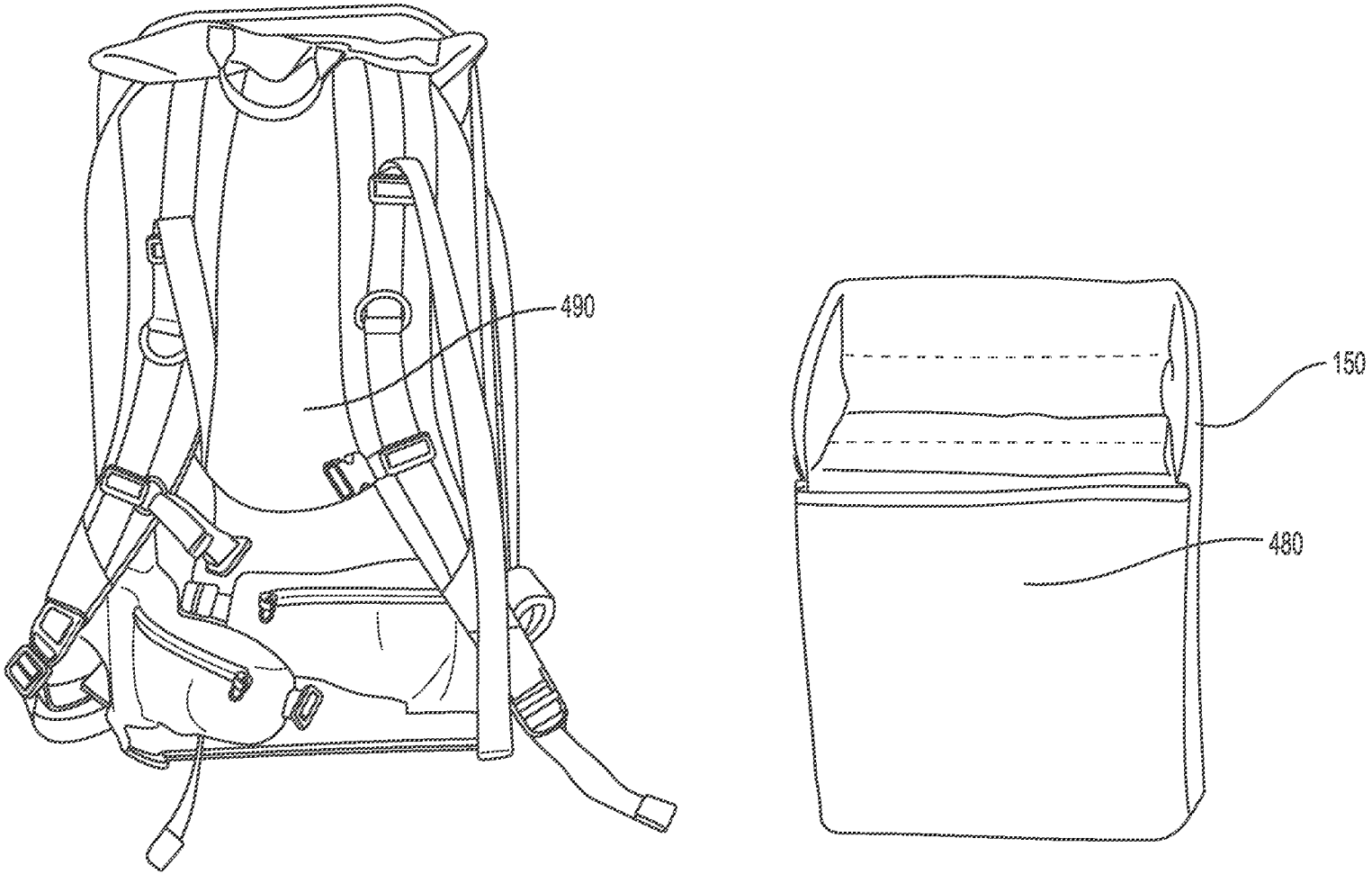
FIG. 18 is a view of two possible embodiments of an insertable/removable core device/component comprising a transformable divider.

In FIG. 18, an embodiment in which the removable core is an insert designed to be inserted into a larger container is illustrated (480). Such an insert designed to be inserted into a larger container may not comprise its own carrying mechanism(s). Such an insert may have access portals designed into any face of the insert so as to provide access points to any storage area defined by the insert and correspondingly any area of the larger container into which it is inserted. Although shown in these FIGURES as a backpack insert, an insert or core comprising one or more transformable dividers according to the invention may be designed so as to be customized to fit any existing larger storage container, such larger storage container being intended to be carried, such as any type of luggage, for example, a backpack, purse, carrying case such as a briefcase or computer or laptop bag, or the like; which larger container may be intended to be somewhat portable, such as a storage box, crate, cargo container, and the like; or may be intended to be essentially immobile, such as a stationary storage unit. Such an insert, in such cases, expands upon and also or alternatively provides enhanced space configuration options not provided by the larger container when used without the removable insert. Some such existing larger storage containers may comprise existing structures to which the insert core could releasably attach, or also or alternatively the insert core may be accompanied by other elements designed to help the core cooperate with a specific larger container. As a non-limiting example, an existing on-market backpack may have features such that the insert core may clip or attach to them in order to secure the insert core to the larger backpack, providing it with new and additional functionality not previously present. Also or alternatively, the insert core may further comprise additional features serving as securement mechanisms, such securement mechanisms either being specifically designed to work in cooperation with an existing larger container or provided as a set of, for example, optional, selectable units. As a non-limiting example, the insert core may be provided as part of a kit, the kit further comprising a variety of mechanisms which may be selectively chosen by the user as best suited to aid in releasably attaching the insert core to the target larger container.

In an alternative embodiment, the insert or removable core is an insert designed to be inserted into a larger container wherein the insert may function as a completely separate carrying device, having incorporated within it one or more carrying mechanisms as illustrated as a backpack with carrying straps in (490) of FIG. 18. The removable core may include many similar features as in previously and later described systems such as transformable dividers, storage compartments of varying sizes, shapes and accessibility points, carrying devices, convenience features, an internal frame, etc., the description of which will not be repeated here. The removable insert has the optionality of being designed such that it may operate as a "mini" complete system as previously described, able to be inserted into a larger pack which provides additional storage capacity. The advantage of the insert is such that the larger system into which it fits may, for example, be too large to be allowed as a carry-on item by an airline. As such, the smaller insert may be removed and carried onto an airplane while the larger system is loaded as checked baggage. In this way, valuables may be retained by the owner during travel. Another example of such a use may be that if the system is being used to carry photography equipment during travel, perhaps only specific pieces of equipment are required on a particular day or photo shoot. In this way, all gear may be transported in a single system, however the selection of only required elements for a particular day may be placed into the smaller core system and utilized at any one particular time. As described for alternative embodiments, such an insert may be designed so as to be customized to fit any existing larger storage container. Such an insert, in such cases, expands upon and also or alternatively provides enhanced space configuration options not provided by the larger container when used without the removable insert.

The fit of the removable core insert within a larger system is exemplified in FIGS. 19-23. In these figures, the embodiment of a simple removable insert lacking independent carrying mechanism(s) is exemplified, however one should interpret such illustration as being exemplary and representative of, in addition to such an illustrated core, a removable core capable of operating independently from a larger storage container. Containers that are adapted/configured to receive such a core also can be considered an aspect of the invention.

Figure 19:
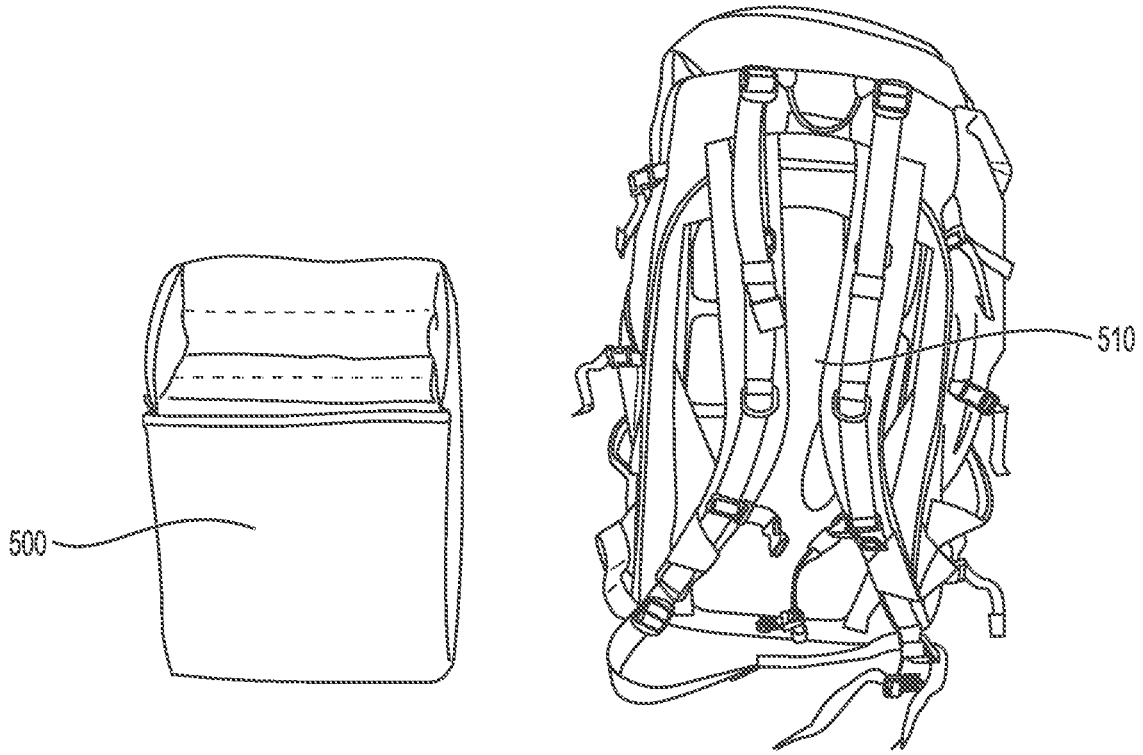
FIG. 19 is a view of one embodiment of a system having an insertable/removable core container/component/device with the core outside of and separate from the larger ("master") container part of a master container system.
Figure 20:
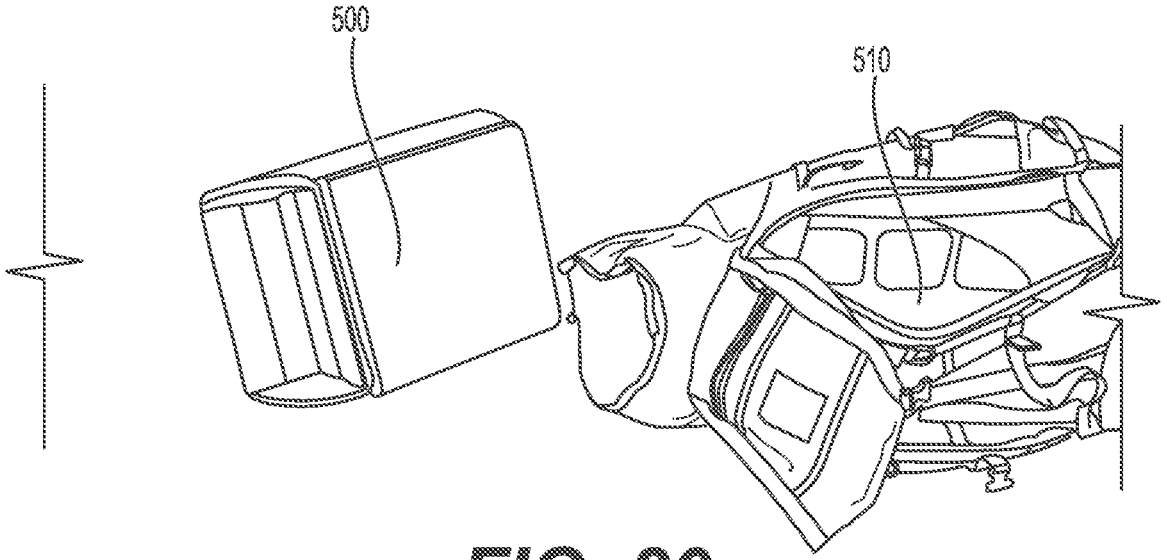
FIG. 20 is a view of one embodiment of a system having an insertable/removable core with the core outside and separate from the master container system but aligned for insertion.
Figure 21:
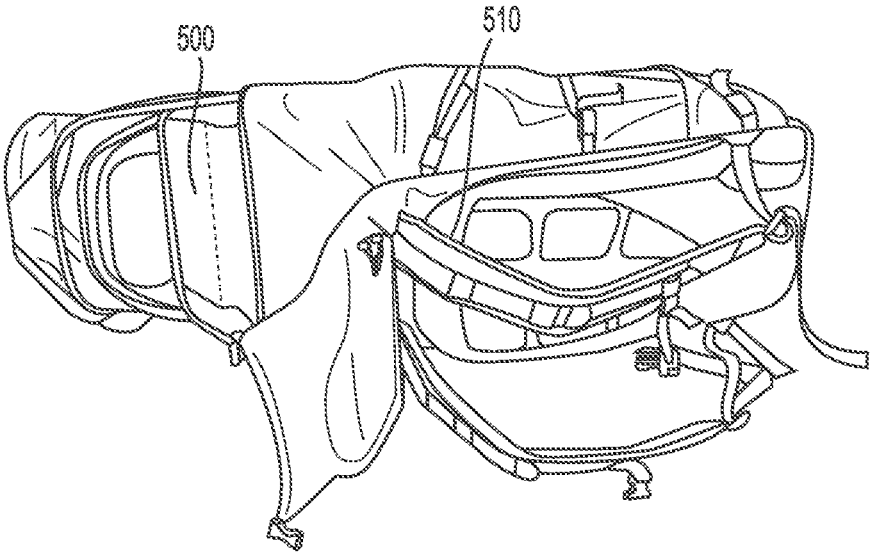
FIG. 21 is a view of one embodiment of a system having an insertable/removable core with the core partially inserted into the master container.
Figure 22:
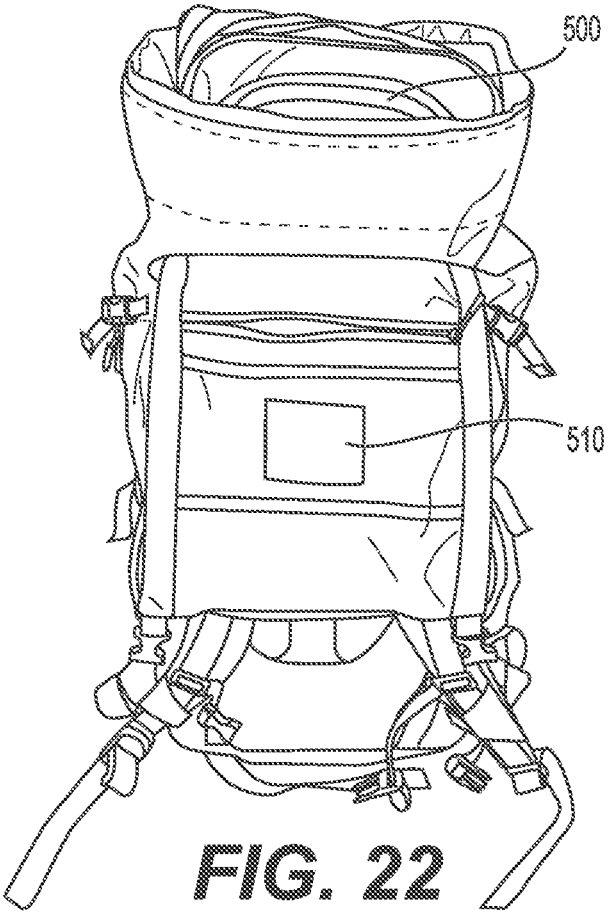
FIG. 22 is a view of one embodiment of a system having an insertable/removable core with the core fully inserted into the larger, master container.

In FIG. 19, the removable storage core (500) starts as an independent unit from the larger storage system (510). In FIG. 20, the removable storage core (500) is placed in an example alignment for insertion into the larger system, (510), facilitated in this embodiment by an opening in the top of the larger storage system. One might envision the insertion being made via alternative openings in the larger system. FIG. 21 illustrates the removable storage core (500) being placed into the larger system (510); here shown approximately 50% inserted. In FIG. 22, the removable storage core (500) has been completely inserted into the larger system (510).

Figure 23:
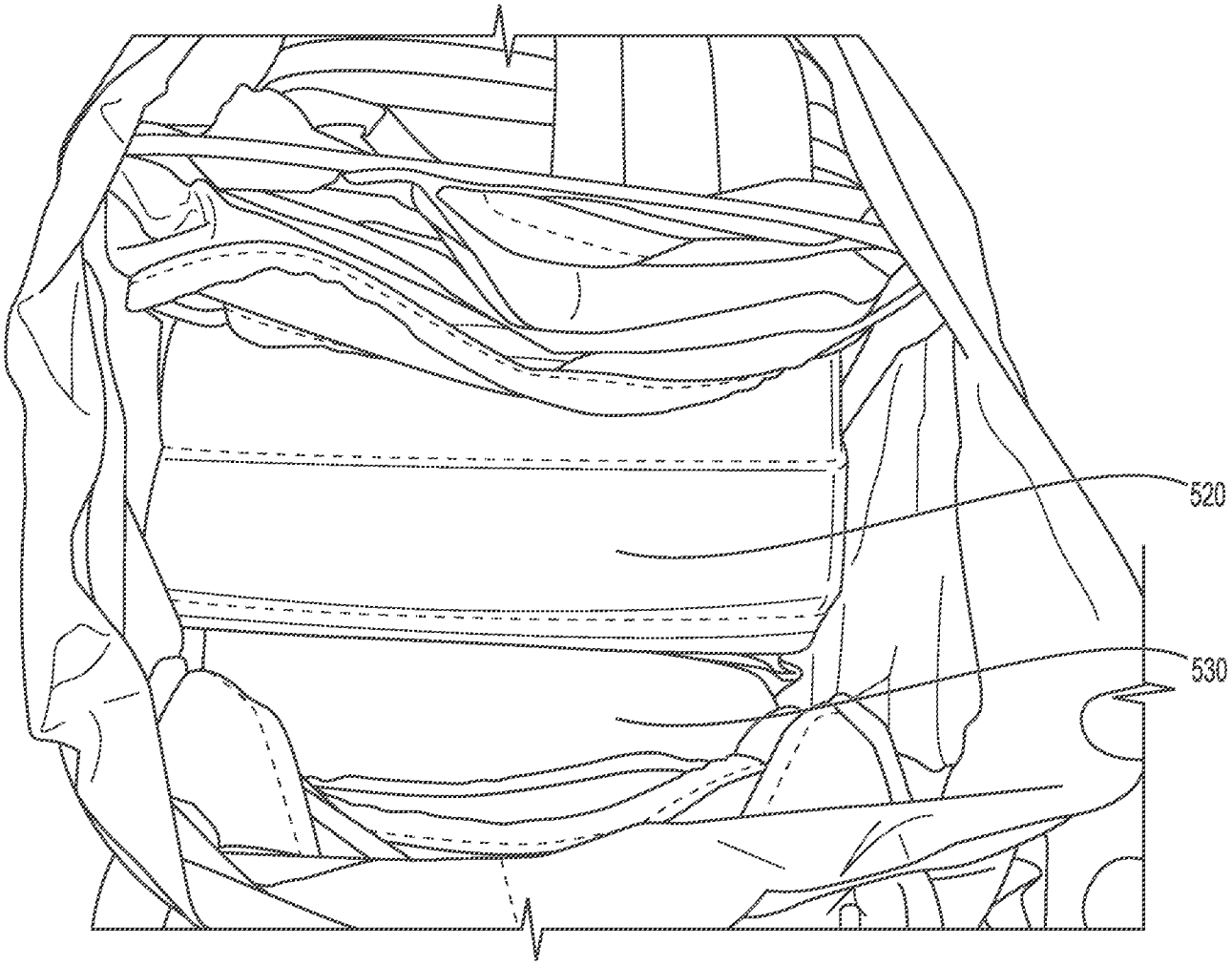
FIG. 23 is a view of one embodiment of a system having an insertable/removable core with the core fully inserted into the larger, master container and components of the insertable/removable core working cooperatively with components of the larger master container.

The removable core system may be designed in such a manner so as to allow features comprising the inner core to work synergistically with the larger system. FIG. 23 exemplifies such a synergy. In FIG. 23, the transformable divider of the inner core (520) when in the extended position as shown may align with a transformable divider of the larger storage system (530) when in its extended position, creating a large, flat, horizontal surface serving as an even base or floor for the storage section created above it. In addition, the removable core system may interface with the larger storage system via a track mechanism to ensure proper positioning and ease of insertion within the larger storage system.

In addition to the functional divider features previously described, numerous advantageous and functional elements may be incorporated alongside the divider features to create a system which encompasses a broad range of functionality and makes such a system extremely flexible and useful for a broad range of users and across a broad range of uses and purposes. Such features may be applied either to a system as described previously made of a single unit or a system as previously described wherein there is a removable storage core, such that the removable storage core may also incorporate such functional features.

Such additional features may include shoulder harnesses or straps. Such shoulder harnesses may incorporate padding and cushioning to improve comfort, pockets or other such additional storage areas to allow quick access to small items, clips, straps or other attachment mechanisms to facilitate carrying an item or items external to the pack for easy access, i.e. rounded clips to hold stability-aiding hiking or walking sticks. Such shoulder harnesses may include straps and clips allowing connection of one shoulder harness to the other, spanning across the user's chest or abdomen, so as to hold the pack close to the wearer's body to hold it in a balanced and comfortable position. Such straps may be used to adjust the center of gravity of the pack. Alternative carrying devices may also include handles or traditional bookbag-style strapping known in the art.

A container of the invention, such as those exemplified herein, can contain one or more selectively storable/hidden (compressible and containable) but externally deployable storage sacks. Such sacks may be attached to the storage system, for example within a pocket on a backpack waist belt and stored in such pocket until needed. When needed, the sack may be pulled from the pocket and deployed externally, attached to the internal area of the pocket yet hanging once deployed outside of the pocket from such attachment, at the wearer's waist, being conveniently available to hold items which may require fast and easy access.

Other such additional features of a storage system in the embodiment of a backpack may include a back panel which, when the pack is worn by a user, rests against the users back. Such a panel may have a core of undulating foam of such a strength so as to maintain integrity of the pack but so as to offer a cushion against the pressure of the pack on the wearer. The undulating foam creates areas where the back panel is in contact with the wearer's back and areas which remain apart from the wearer's back, creating opportunities for airflow to pass across the wearer's back providing heat relief.

A function of the storage systems described, more specifically the transformable divider and the reconfigurable divider, is the flexibility they provide in terms of space allocation and accessibility. Such accessibility may be enhanced by providing multiple openings built into differing areas of the pack. These openings in different areas of the pack may provide multiple access points to the same storage compartment. For example, a first access to one storage compartment may be through a zippered opening in the front, external portion of the pack, and a second access to the same storage compartment may be provided through a cinched opening in the top of the pack, and a third access to the same storage compartment may be provided through a zippered opening on the back of the pack. According to some embodiments, the transformable divider itself may have an incorporated access allowance device, such as a zippered central hinge, window within a sidecover, or the like which does not impact the functionality of the transformable divider yet which allows the user to access both the stored content in the storage area defined by the front of the transformable divider as well as the content stored in a storage area defined by the back of the transformable divider. Any permanent structure, wall, shell or cover defining separate storage compartments may, within it, incorporate an access allowance device such as a zipper, window, flap, or the like such that when a user is accessing one compartment of a pack, it is possible to, from that location, also access a separate compartment, such separate compartment also being accessible from an alternative, second access point located in a different location within the pack. This provides the opportunity to, for example, keep the storage container (i.e. backpack) in one orientation while accessing multiple storage compartments as opposed to having to close one section, re-orient the pack, and access a second storage section. If access to such areas is provided by a zippered opening, such a zipper may utilize a larger than standardly used pull tab, a pull tab designed as a loop and protected with added layers so as to keep the loop open to provide quick and easy use and protected from wear.

One might appreciate that such a storage container when in the embodiment of a backpack, may be very useful in carrying equipment, for example photography equipment and related accessories. Technical equipment can be heavy and create a significant load weight. The ability to carry such a load weight may be eased by the incorporation of weight bearing hip straps and internal framing which directs the load weight of the pack to the hips, reducing the weight burden of the pack on the wearer's shoulders. Externally affixed strapping in a multitude of directions across the pack may be used to cinch the contents of the pack tightly together and to shift the center of gravity of the pack so as to keep it centered and balanced upon the user's body. Such straps may be connected using snaps or clips of multiple designs known in the art but may also incorporate useful yet more uncommon features such as a whistle, i.e. for safety purposes, a small container in and of itself so as to hold small tools (i.e. tweezers or matches), or otherwise designed to incorporate a feature which may provide useful in an environment in which a backpack or carrying container in/on which it is used may prove useful.

Other convenience elements that may be incorporated into a pack to maximize its functionality may be pouches, pockets, slots and storage spaces along the interior and external walls of the pack. Such storage areas may be optionally designed with or without a closure device such as a Velcro® hook-and-loop closure, zipper, snap, tie, cinch or other such closure system.

EXEMPLARY ASPECTS OF THE INVENTION

The following list of exemplary aspects is provided to further aid in illustrating selected aspects of the present invention. This list of aspects should be interpreted as illustrative of and not providing limits to or on, the spirit of the invention described herein, which should only be limited by limitations of any claims made in association with this disclosure:

1. A container comprising a section comprising:
   (a) a set of opposing sidewalls having a top end and a bottom end, each sidewall comprising a friction reduction area located near one or more ends, and
   (b) a dual position transformable divider comprising a first panel and a second panel connected by a central hinge, the divider being capable of assuming a first position and a second position by applying a force on at least one panel such that the panels transitionally move about the hinge, the first panel being horizontally oriented in the first position and vertically oriented in the second position and the first and second panels being substantially perpendicular to each other in either position;
2. The container of aspect 1, wherein each panel optionally comprising a seam located within the interior of the panel;
3. The container of aspect 1 or aspect 2, wherein substantially all of the first panel and the second panel being disposed below the top end of the side walls in the second position;
4. The container of any one of aspects 1-3, wherein the panels comprise a core composed of a material that has a tensile strength of at least about 600 and a density of at least about 40 $kg/m^3$;

5. The container of any one of aspects 2-4, wherein each panel of the transformable divider comprises a seam that is located approximately in the center of the panel;
6. The container of any one of aspects 1-5, wherein each panel of the transformable divider comprises a cushion layer;
7. The container of aspect 6, wherein at least the cushion layer reversibly compresses at least about 25% in depth when contacted with a force equivalent or greater to placement of an object of at least about 375 grams;
8. The container of any one of aspects 1-7, wherein each sidewall comprises a cushion layer and the sidewall cushion layers are configured such that the sidewall cushion layer is in direct or indirect contact with the end of at least one panel of the transformable divider when the panels are in the first or second position;
9. The container of any one of aspects 1-4, wherein each of the panels of the transformable divider is between about 1 inch (2.5 cm) and about 5 inches (13 cm) in height;
10. The container of any one of aspects 1-9, wherein the length of either panel of the transformable divider does not vary by more than about 5% in any part of the panel;
11. The container of any one of aspects 1-10, wherein the panels of the transformable divider are substantially identical in length, width, shape, or any combination thereof;
12. The container of any one of aspects 1-11, wherein the friction reduction area is formed by a region of reduced sidewall thickness;
13. The container of aspect 12, wherein the thickness of the sidewall is reduced at least about 25% within the friction reduction area having the lowest thickness compared to the sidewall thickness outside of the reduced friction area;
14. The container of any one of aspects 1-8, wherein the friction reduction area is at least about 1 inch (about 2.5 cm) in length;
15. The container of any one of aspects 1-14, wherein the width of the sidewall in the reduced friction area is reduced along a slope creating an angled end to the sidewall;
16. The container of aspect 15, wherein the reduction in width of the sidewall is any amount greater than 0% up to and including 100% over the course of the slope;
17. The container of any one of aspects 12-16, wherein the reduction in the thickness of the sidewall in the reduced friction area ranges from about 5% to about 70%;
18. The container of any one of aspects 12-17, wherein the reduced thickness area has a first length and a second length, wherein the first length is at least about 25% of the second length;
19. The container of any one of aspects 12-18, wherein the reduced thickness area has a maximum length of about 2 inches (about 5 cm);
20. The container of any one of aspects 12-18, wherein the reduced thickness area is composed of areas of different length, wherein the maximum length of the reduced thickness area is about 3 inches (about 7.6 cm) and the minimum length of the reduced width area is about 0.1 inches (about 0.25 cm);
21. The container of aspect 13, wherein the reduced thickness area maximum length is about 1.5 inches in length and the minimum length is about 1 inch (about 2.5 cm) in length;
22. The container of any one of aspects 1-21, wherein each top and bottom panel of the transformational section comprises a top portion and a bottom portion wherein the top portion and bottom portion are of approximately similar height and in the first position the sides of the top portion of the top panel are in closer proximity to the sidewall than the top portion of the bottom panel;
23. The container of any one of aspects 1-22, wherein the sidewalls are formed by separate parts that are separately housed in the container;
24. The container of any one of aspects 1-23, wherein each of the sidewalls comprise central stitching;
25. The container of any one of aspects 1-23, wherein each of the sidewalls do not comprise central stitching;
26. The container of any one of aspects 1-25, wherein the position of the top edge of a top panel, and a bottom edge of a bottom panel of a transformable divider, when operating independently of any other transformable divider which may be present, is fixed and remains in a substantially constant position as the transformable divider is modified from a first position to a second position;
27. The container of any one of aspects 1-26, wherein the container comprises a sidecover component comprising a flexible material that connects to the exterior-facing ends of transformable divider panels such that when in the first position the sidecover component stretches to cover the area outward and downward from the first (top) panel, and outward and in front of the second (bottom) panel, and adjacent to the sidewall;
28. The container according to any one of aspects 1-27, wherein the transformable divider further comprises a member for facilitating the transition of the transformable divider between the first position and the second position;
29. The container according to aspect 28 wherein the member for facilitation the transition of the transformable divider is a handle;
30. The container of any one of aspects 1-29, wherein substantially all parts of the first panel remain in a substantially perpendicular position to the second panel in either position after more than 10 hours of use;
31. The container of any one of aspects 1-30, wherein substantially all parts of the first panel remain in a substantially perpendicular position to the second panel in either position after more than 10 transitions of the transformable divider from a first position to a second position;
32. The container of any one of aspects 8-31, wherein each panel and each sidewall each comprises a cushion layer and wherein the cushion layer is oriented towards the interior of the container;
33. The container of aspect 32, wherein panels of the transformable divider comprise cushion layers on both sides of the panels so that a cushion layer is oriented toward the interior of each storage compartment defined by each side of the transformable divider;
34. The container of any one of aspects 4-33, wherein the core material is primarily composed of an elastomeric polymer board having a width of about 0.5-2 cm;
35. The container of aspect 34, wherein the polymer is primarily composed of ethyl vinyl acetate (EVA);
36. The container of aspect 35, wherein the EVA lacks visible open cells;
37. The container of any one of aspects 4-36, wherein the strength of the core material is at least about 10% greater than the strength of the corresponding panel materials used in the Atlas Packs LLC Series 1 Athlete Pack (S1AP);

38. The container of any one of aspects 4-37, wherein the density of the elastomeric polymer is at least about 10% greater than the density of the corresponding panel material used in the S1AP;

38. The container of any one of aspects 1-38, wherein the container experiences no deformation of more than about 15 degrees in more than about 5% in the panels of the transformational divider after 10 hours of use;

39. The container of any one of aspects 1-39, wherein the container experiences no deformation of more than about 15 degrees in more than about 5% of the panels of the transformational divider after 10 transitions from a first position to a second position;

40. The container of any one of aspects 1-39, wherein the section is an integrated part of the container;

41. A removable device which resides within a larger storage system, the removable device comprising any one or more characteristics described in any one of aspects 1-39;

42. The container of any one of aspects 1-39, wherein the container is a removable/insertable core capable of being inserted and removed from one or more master containers;

43. The container of any one of aspects 41 or 42, wherein the larger container is a luggage-type container;

44. The container of any one of aspects 1-43, wherein the container is a backpack comprising the typical elements of a backpack (including two straps and a frame and a size suitable for wearing on the back of a person);

45. The container of any one of aspects 41-44, wherein the master container comprises first and second openings that are in alignment with an area formed by the first position and the second position, respectively;

46. The container of any one of aspects 1-45, wherein the container further comprises one or more selectively openable access mechanisms that when opened allows access to space formed by the transformable divider when in a first position, second position, or both positions;

47. The container of aspect 46, wherein the selectively openable enclosure is directly or indirectly attached to the interior top of the first panel of the transformable divider and is substantially flush with the exterior of the first panel;

48. The container of any one of aspects 1-47, wherein the container is a removable device which resides within a larger "master" storage system, the removable device comprising:

(a) a set of opposing sidewalls having a top end and a bottom end, each sidewall comprising a friction reduction area located near one or more ends, and (b) a dual position transformable divider comprising a first panel and a second panel connected by a central hinge, the divider being capable of assuming a first position and a second position by applying a force on at least one panel such that the panels transitionally move about the hinge, the first (upper) panel being horizontally oriented in the first position and vertically oriented in the second position and the first and second panels being substantially perpendicular to each other in either position, each panel optionally comprising a seam located within the interior of the panel, and substantially all of the first panel and the second panel being disposed below the top end of the side walls in the second position;

49. The container of aspect 48, wherein the device does not comprise an independent carrying mechanism;

50. The device of any one of aspects 48 or 49, wherein the device comprises an external coating ready for weather exposure, straps or other components for attachment to transportation or the body, external pockets or compartments, an external identification/contact information holder, a lock, or a combination of any or all thereof, such that the device can be used as luggage without the need for a larger container;

51. The device of aspect 48, wherein the device comprises an independent carrying mechanism;

52. The device of aspect 51, wherein the device comprising an independent carrying mechanism is designed to be capable of being utilized independent from a larger, master storage system;

53. The device of aspect 52, wherein the device is a backpack;

54. A container comprising two or more adjacent dual position transformational dividers, at least one of the transformational dividers comprising a first panel and a second panel connected by a central hinge, the divider being capable of assuming a first position and a second position by applying a force on at least one panel such that the panels transitionally move about the hinge, the first (upper) panel being horizontally oriented in the first position and vertically oriented in the second position and the first and second panels being substantially perpendicular to each other in either position, the divider being capable of aligning with the back and sidewalls of a cargo core in the first position;

55. The container of aspect 54, wherein the dual position transformation dividers comprise a first divider according to any one of aspects 1-8 and a second dual position transformational divider comprising a third panel that is movably attached directly or indirectly to a panel of the first divider and aligned with the sidewalls and bottom of the cargo core in a first position and assuming a perpendicular orientation in the second position where causing the second divider to be in the second position also causes the second panel of the first divider to be substantially parallel with the first panel in a horizonal position that is raised above the bottom of the cargo core;

56. The container of any one of aspects 54 or 55, wherein the container comprises two dual position dividers that are not in contact with each other;

57. The container of aspect 56, wherein the dual position dividers are positioned at two opposite ends of the cargo core;

58. A container divider comprising at least three interconnected panels connected by one or more connecting hinges that allow each of the panels to move at least approximately 330 degrees (e.g., about 360 degrees) about the hinges and a stabilization component that connects at least some of the panels to a corresponding material;

59. The divider of aspect 58, wherein the divider comprises a first type of hinge and a second type of hinge, wherein the first type of hinge is formed by a first connector connected to a central portion of one end of at least two panels and a second type of hinge formed by separated second and third connectors positioned at the outer ends of at least two panels, wherein there is no overlap between the first type and second type of hinge in connecting panels within the divider;

60. The divider of any one of aspects 58 or 59, wherein the divider comprises at least four panels and the four panels are capable of being positioned about the hinges of the divider such that each panel is substantially perpendicular to two other panels and is in alignment with the other panel;

61. The divider of any one of aspects 58-60, wherein the panels are capable of stacking one on top of another to form a compact, closed position;

62. The divider of any one of aspects 58-60, wherein the panels comprise a core composed of an elastomeric material;

63. The divider of any one of aspects 58-62, wherein the divider is coated with a water-resistant or water-proof and tear-resistant material;

64. The divider of any one of aspects 58-63, wherein the divider is between about 8 inches and about 36 inches (about 20 cm and about 91 cm) in length;

65. The divider of any one of aspects 58-64, wherein the divider is between about 3 and about 10 inches (about 8 and about 25 cm) in height;

66. The divider of any one of aspects 58-65, wherein one or more sides of one or more panels of the divider comprise a cushion material;

67. The divider of any one of aspects 58-66, wherein the divider further comprises a stabilization component;

68. The divider of aspect 67, wherein the stabilization component comprises either a hook or loop component that forms one part of a hook-and-loop fastener system;

69. A container comprising a divider according to any one of aspects 58-68 and a component comprising a sufficient amount of the corresponding material such that the divider can contain at least two different cargo items of at least about 250 grams each that are separated by two or more panels of the divider for a period of at least 20 hours without undergoing a deformation of position of more than about 20 degrees in any part of the divider;

70. The container of aspect 69, wherein the container further comprises one or more dual position transformational dividers;

71. The container of any one of aspects 69 or 70, wherein the container is a backpack;

With reference to the Figures provided herein, the following additional exemplary aspect is provided—

72. A repeatedly reversible transformable container comprising a section comprising:

(a) a set of opposing sidewalls (150) having a top end (230) and a bottom end (240), each sidewall comprising a friction reduction area (250) located near one or more ends (230 or 240) and (b) one or more dual position transformable dividers (10), each comprising a first panel (20) and a second panel (30) connected by a central hinge (40), the divider being capable of assuming a first position and a second position by applying a force on at least one panel (20 or 30) such that the panels transitionally move about the hinge (40), the first panel being horizontally oriented in the first position and vertically oriented in the second position and the first and second panels being substantially perpendicular to each other in either position, each panel optionally comprising a seam (120) located within the interior of the panel, substantially all of the first panel and the second panel being disposed below the top end of the side walls (150) in the second position, the panels comprising a core composed of a material that has a tensile strength of at least about 600 and a density of at least about 40 kg/m$^3$;

73. The repeatedly reversible transformable container of aspect 72 wherein the container further comprises one or more container dividers according to any one of aspects 58-68;

74. The repeatedly reversible transformable container of any one of aspects 72-73, wherein the container further comprises a component comprising a sufficient amount of a structural material such that the divider can contain at least two different cargo items of at least about 250 grams each that are separated by two or more panels of the divider for a period of at least 20 hours without undergoing a deformation of position of more than about 20 degrees in any part of the divider;

75. The repeatedly reversible transformable container of aspect 74, wherein the divider is capable of being positioned such that one or more panels are directed in a first direction, one or more panels are directed in a second, substantially opposite direction, one or more panels are positioned such that they are directed in a third direction, such third direction being substantially perpendicular to the first and second directions, one or more panels are directed in a fourth direction which is substantially perpendicular to the first and second directions in an opposite orientation as the third direction, or any combination of any two or more panel directions;

76. The repeatedly reversible transformable divider container of aspect 72, wherein the container is adapted to operate as a repeatedly removable device which resides within a larger "master" storage container that is adapted to engage and stably maintain the transformable divider container when engaged, the transformable divider container and master storage making up a storage system, the removal device comprising:

(a) a set of opposing sidewalls having a top end and a bottom end, each sidewall comprising a friction reduction area located near one or more ends, and (b) a dual position transformable divider comprising a first panel and a second panel connected by a central hinge, the divider being capable of assuming a first position and a second position by applying a force on at least one panel such that the panels transitionally move about the hinge, the first (upper) panel being horizontally oriented in the first position and vertically oriented in the second position and the first and second panels being substantially perpendicular to each other in either position, each panel optionally comprising a seam located within the interior of the panel, and substantially all of the first panel and the second panel being disposed below the top end of the side walls in the second position;

77. The repeatedly reversible transformable divider container of aspect 76, wherein the repeatedly reversible transformable divider container does not comprise an independent carrying mechanism;

78. The device of aspect 76 or aspect 77, wherein the repeatedly reversible transformable divider container comprises an external coating ready for weather exposure, straps or other components for attachment to transportation or the body, external pockets or compartments, an external identification/contact information holder, a lock, or a combination of any or all thereof, such that the repeatedly reversible transformable divider container can be used as luggage without the need for a larger container;

79. The device of aspect 78, wherein the repeatedly reversible transformable divider container comprises an independent carrying mechanism configured to be utilized independently from the larger, master storage system;

80. The device of aspect 79, wherein the repeatedly reversible transformable divider container, the larger container, or both is or are adapted to operate as a backpack;

81. The device of aspect 80, wherein the device is a backpack.

The invention claimed is:

1. A reversibly partially transformable container comprising a section comprising:

(a) a set of opposing sidewall panels each having a top end and a bottom end, each sidewall panel comprising a friction reduction area located near one or more of the ends and each sidewall panel forming at least a part of a sidewall of the container, and (b) one or more dual position transformable dividers, each divider comprising a first divider panel and a second divider panel connected by a central hinge and adapted to assume a first position and to transition to a second position and back again repeatedly and frictionally engaged with said sidewall panels at said friction reduction areas whenever a sufficient force is applied to at least one divider panel such that both of the divider panels transitionally move about the hinge, the first divider panel being horizontally oriented in the first position and vertically oriented in the second position, and the first and second divider panels being substantially perpendicular to each other in either position, at least half of the first divider panel and substantially all of the second divider panel being disposed below the top end of the sidewall panels in the second position and the panels comprising a core composed of a core material that has a tensile strength of at least about 600 KPa and a density of at least about 40 kg/m3, wherein the friction reduction area measurably reduces the friction between the sidewall and the one or more dual position transformable dividers when the one or more dual position transformable dividers transition from the first position to the second position.

2. The reversibly partially transformable container of claim 1, wherein (a) the force required to transform the container is about equal to the relaxed pulling or pushing force of a typical healthy person of about 7 to about 70 years in age; or (b) each panel of the dual position transformable divider and each panel of the sidewall of the container comprise at least one cushion layer, wherein at least the cushion layer(s) of the dual position transformable divider panels reversibly compresses at least about 25% in depth when contacted with a force equivalent or greater to placement of an object of at least about 375 grams and further wherein the sidewall cushion layer of each sidewall panel is configured such that it is in direct or indirect contact with the end of at least one panel of the dual position transformable divider when the panels are in a first or second position; or (c) the operation of the reversibly partially transformable container is in accordance with both (a) and (b).

3. The reversibly partially transformable container of claim 2, wherein each dual position transformable divider panel comprises a top portion and a bottom portion wherein the top portion and bottom portion are of approximately similar height and in the first position the sides of the top portion of the first panel are in closer proximity to the sidewall panels than the bottom portion of the first panel.

4. The reversibly partially transformable container of claim 2, wherein in at least 95% of reversibly partially transformable containers, substantially all parts of the first panel remain in a substantially perpendicular position to the second panel in either the first or second position, and experience no deformation of more than about 15 degrees, after (a) at least about 10 hours of use of the transformable container; or (b) at least 10 transitions of the transformable divider from the first position to the second position, or (c) after both (a) and (b) have occurred.

5. The reversibly partially transformable container of claim 4, wherein the core material is at least primarily composed of an elastomeric polymer board having a thickness of about 0.5-about 2 cm.

6. The reversibly partially transformable container of claim 5, wherein the board is at least primarily composed of an ethyl vinyl acetate (EVA) material lacking visible open cells.

7. The reversibly partially transformable container of claim 4, wherein the reversibly partially transformable container operates as a removable/insertable core for a master container by being adapted to be stably inserted and removed from one or more larger master containers that are specifically adapted to receive and maintain the reversibly partially transformable container.

8. A master container system comprising:

a. a master container that comprises: i) at least one protective covering, at least one additional container, at least one transport-facilitating apparatus, or a combination of two or all thereof; ii) at least one container receiving section that is adapted to receive and stably maintain a reversibly partially transformable container and to allow operation of the transformable divider when the reversibly partially transformable container is contained therein; and b. at least one reversibly partially transformable container according to claim 7.

9. The reversibly partially transformable container of claim 8, wherein the container comprises two dual position dividers that are not in contact with each other.

10. The reversibly partially transformable container of claim 2, wherein the dual position transformation dividers comprise a first dual position transformable divider and a second dual position transformational divider, the second dual position transformational divider comprising a third panel that is movably attached directly or indirectly to the second panel of the first dual position transformable divider and aligned with the sidewalls and back of the reversibly partially transformable container in a first position and assuming a perpendicular orientation in the second position where causing the second divider to be in the second position also causes the second panel of the first divider to be substantially parallel with the first panel in a horizontal position that is raised above the bottom of the reversibly partially transformable container.

11. The reversibly partially transformable container of claim 1, wherein each of the dual position transformable divider panels is between about 1 inch and about 5 inches in height and the length and width of the two panels of the dual position transformable divider are substantially identical.

12. The reversibly partially transformable container of claim 11, wherein the position of the top edge of a top panel, and a bottom edge of a bottom panel of the dual position transformable divider, when operating independently of any other dual position transformable divider present, is fixed and remains in a substantially constant position as the transformable divider transitions from the first position to a second position.

13. The reversibly partially transformable container of claim 12, wherein the container comprises (a) a sidecover component comprising a flexible material that connects to the exterior-facing ends of the dual position transformable divider panels such that when in the first position the sidecover component stretches to cover the area downward from the first (upper) panel, outward and in front of the second (lower) panel, and adjacent to the sidewall; or (b) a member for facilitating the transition of the transformable divider between the first position and the second position; or (c) both the sidecover component of (a) and the transition facilitating member of (b).

14. The reversibly partially transformable container of claim 13, wherein the sidewalls are formed by separate parts that are separately housed in the reversibly partially transformable container.

15. The reversibly partially transformable container of claim 1, wherein the friction reduction area is formed by:

(a) an area of reduced sidewall panel thickness, wherein the thickness of the sidewall panel is from about 1% to about 70% of the thickness of the sidewall panel in a non-reduced thickness area, and the reduced thickness area is at least about 1 inch in length and which may vary in thickness over the course of that length; or (b) a reduced sidewall panel width wherein the width is reduced along a slope creating an angled end to the sidewall panel; or (c) the combination of a reduced sidewall thickness according to (a) and a reduced sidewall panel width according to (b).

16. The reversibly partially transformable container of claim 1, wherein the one or more dual position transformable dividers separate a first compartment from a second compartment such that a user is able to access each compartment individually without entering the other, and access to the first compartment from the second compartment or access to the second compartment from the first compartment requires at least one secondary access point.

17. The reversibly partially transformable container of claim 16, wherein the first panel, the second panel, or both the first and second panels, comprise an interior positioned seam.

18. The reversibly partially transformable container of claim 1, wherein the container is non-collapsible.

19. The reversibly partially transformable container of claim 18, wherein each of the one or more the dual position transformable dividers are permanently attached, either directly or indirectly, to the container such that they cannot be removed.

20. The reversibly partially transformable container of claim 18, wherein each of the one or more dual position transformable dividers only contain two divider panels of substantially the same length and width.

* * * * *